US005948603A

United States Patent [19]

Uchihiro et al.

[11] Patent Number: 5,948,603

[45] **Date of Patent: *Sep. 7, 1999**

[54] METHOD OF PROCESSING BLACK AND WHITE SILVER HALIDE PHOTOGRAPHIC LIGHT SENSITIVE MATERIAL

[75] Inventors: Shinji Uchihiro; Shoji Nishio, both of Hino, Japan

[73] Assignee: Konica Corporation, Tokyo, Japan

[ * ] Notice: This patent is subject to a terminal disclaimer.

[21] Appl. No.: 08/975,128

[22] Filed: Nov. 20, 1997

[30] Foreign Application Priority Data

Nov. 26, 1996 [JP] Japan ..... 8-314807

[51] Int. Cl.[6] ..... G03C 5/29

[52] U.S. Cl. ..... 430/445; 430/446; 430/488; 430/491

[58] Field of Search ..... 430/434, 445, 430/446, 488, 490, 491

[56] References Cited

U.S. PATENT DOCUMENTS 5,364,746 11/1994 Inoue et al. ..... 430/490
5,707,790 1/1998 Yanagisawa ..... 430/491

FOREIGN PATENT DOCUMENTS 6-308680 11/1994 Japan .

*Primary Examiner*—Hoa Van Le

*Attorney, Agent, or Firm*—Frishauf, Holtz, Goodman, Langer & Chick, P.C.

[57] ABSTRACT

Disclosed is a method of processing an exposed black and white photographic light-sensitive material employing an automatic processor, the method comprising the steps of developing the exposed material with a developer, the developer is replenished with a developer replenisher; fixing the developed material with a fixer; washing the fixed material; and drying the washed material, wherein the developer contains a developing agent, a compound represented by the following formula (III) and at least one of a compound represented by the following formula (I) and a compound represented by the following formula (II):

Formula (I)

Formula (II)

Formula (III)

$Z^1$—$SM^1$.

11 Claims, No Drawings

METHOD OF PROCESSING BLACK AND WHITE SILVER HALIDE PHOTOGRAPHIC LIGHT SENSITIVE MATERIAL

FIELD OF THE INVENTION

The invention relates to a method of processing a black and white silver halide photographic light sensitive material.

BACKGROUND OF THE INVENTION

Recently, in the field of silver halide photographic light sensitive material field, rapid processability for a silver halide photographic light sensitive material, and reduction of a processing replenisher replenishing amount or a processing waste solution are required. Much study on the silver halide photographic light sensitive material, processing solutions and automatic processors has been made.

Reduction of the developer replenisher replenishing amount lowers oxidation resistance, since the developer remains for a long time. Therefore, addition of a larger amount of a sulfite, a carbonate or a borate to the developer is effective but results in excessively high salt concentration.

Ions such as Ca, Mg and Fe are entered into processing solutions from water for dissolving the processing composition, or from light sensitive materials to be processed. These ions react with a carbonate ion to produce precipitates or silver sludge, resulting in soil on the rollers of an automatic processor or uneven development.

As a chelating agent to sequester such metal ions are known ethylenediaminetetraacetic acid (EDTA) and ethylenetriaminepentaaacetic acid (ETPA). However, these chelating agents react with the small amount of an iron salt present in developers to produce iron chelate compounds which have the disadvantage of accelerating oxidation reaction of the developing agent in the developer. Further, in waste solutions these chelating agents have poor biodegradability and are difficult to decompose in treatment facilities for drainage, resulting in environmental problems.

Recently, chelating agents with high biodegradability have been used. However, though these agents enhance oxidation resistance and improve biodegradability, they cause problems in greatly increasing residual color on the processed light sensitive material. When a light sensitive material containing a hydrazine compound to provide a high contrast, image is processed in an automatic processor, there occur the following major problems: the linearity of the characteristic curve or image sharpness markedly deteriorates, fog nuclei at unexposed portions of the processed material increase, a large amount of black points, so-called black spots, occur at edge portions of the processed material, resulting in an adverse effect on photographic properties of the processed material, and soil occurs inside the automatic processor.

SUMMARY OF THE INVENTION

An object of the invention is to provide a method of processing a black and white silver halide photographic light sensitive material, wherein the method results in no environmental problems, no adverse effect on the photographic properties of the processed light sensitive material, no black spots on the processed light sensitive material and no soil on the processed light sensitive material or inside the automatic processor.

DETAILED DESCRIPTION OF THE INVENTION

The above problems can be solved by the following:

(1) A method of processing a black and white photographic light-sensitive material employing an automatic processor capable of carrying out a developing process, a fixing process, a washing process and a drying process, wherein a developer used in the developing process contains a compound represented by the following formula (III) and at least one of a compound represented by the following formula (I) and a compound represented by the following formula (II):

Formula (I)

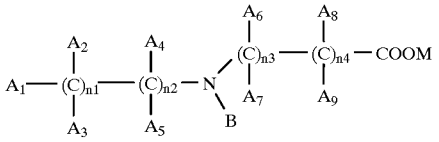

wherein B represents a hydrogen atom, —OH, or —$CH_2COOM$; provided that when B represents a hydrogen atom, $A_1$, $A_2$, $A_3$, $A_4$, $A_5$, $A_6$, $A_7$, $A_8$, and $A_9$ in dependently represent a hydrogen atom, —$C_nH_{2n+1}$ or —$(CH_2)_mX$ in which n is an integer of 1 to 3, m is an integer of 0 to 3, and X represents —COOM, $NH_2$ or —OH, and all of $A_1$, $A_2$, $A_3$, $A_4$, and $A_5$ are not simultaneously hydrogen atoms, or when B represents —OH or —$CH_2COOM$, $n_1$ and $n_2$ are integers satisfying $n_1+n_2=2$, $n_3$ is 0, $n_4$ is 1, $A_1$, $A_8$ and $A_9$ represent hydrogen atoms, $A_2$, $A_3$, $A_4$, and $A_5$ independently represent a hydrogen atom, —OH, —COOM, —$PO_3(M)_2$, —$CH_2COOM$, —$CH_2OH$ or a lower alkyl group and at least one of $A_2$, $A_3$, $A_4$, and $A_5$ represents —$CH_2COOM$, —COOM, —COOM or —$PO_3(M)_2$; and M represents a hydrogen atom, an alkali metal atom or an ammonium group, Formula (II)

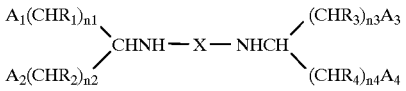

wherein $A_1$, $A_2$, $A_3$ and $A_4$ independently represent —COOM or —OH; $n_1$, $n_2$, $n_3$ and $n_4$ independently represent an integer of 0 to 2; $R_1$, $R_2$, $R_3$ and $R_4$ independently represent a hydrogen atom, —OH or a lower alkyl group; X represents an alkylene group having 2 to 6 carbon atoms or —$(B_1O)_m$—$B_2$— in which $B_1$ and $B_2$ independently represent an alkylene group having 1 to 5 carbon atoms, and m represents an integer of 1 to 5; and M represents a hydrogen atom, an alkali metal atom or an ammonium group, $Z^1$—$SM^1$ Formula (III)

wherein $Z^1$ represents an alkyl group, an aryl group or a heterocyclic group, provided that each group has, as a substituent, at least one selected from the group consisting of a hydroxy group, —$SO_3M_1$, —$COOM_1$ (in which $M_1$ represents a hydrogen atom, an alkali metal atom or a substituted or unsubstituted ammonium group), a substituted or unsubstituted amino group and a substituted or unsubstituted ammonio group or a substituent having at least one selected from the above mentioned group; $M^1$ represents a hydrogen atom, an alkali metal atom or a substituted or unsubstituted amidino group (which may form a hydrogen halogenide salt or a sulfonic acid salt), (2) the method of item 1 above, wherein the content ratio (molar ratio) of at least one of the compound represented by formula (I) and the compound represented by formula (II) to the compound represented by formula (III) is 0.1:1 to 100:1, (3) the method of item 1 or 2 above, wherein the at least one of the compound represented by formula (I) and the compound represented by formula (II) is ethylenediamine-N,N'-disuccinic acid (EDDS), (4) the method of item 1, 2 or 3 above, wherein the material comprises Ca in an amount of 0 to 15 mg/m$^2$, (5) the method of item 1, 2, 3 or 4 above, wherein the replenishing amount of a fixer replenisher is 50 to 250 ml/m$^2$, or (6) the method of item 1, 2, 3, 4 or 5 above, wherein the at least one of the compound represented by formula (I) and the compound represented by formula (II) is an [S, S] isomer, (7) a method of processing an exposed black and white photographic light-sensitive material employing an automatic processor, the method comprising the steps of:

developing the exposed material with a developer, the developer is replenished with a developer replenisher;

fixing the developed material with a fixer; washing the fixed material; and drying the washed material, wherein the developer contains a developing agent, a third compound represented by the following formula (III) and at least one of a first compound represented by the following formula (I) and a second compound represented by the following formula (II):

Formula (I)

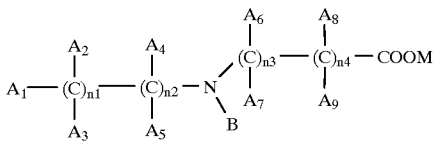

wherein B represents a hydrogen atom, —OH, or —$CH_2COOM$, provided that when B represents a hydrogen atom, $A_1$, $A_2$, $A_3$, $A_4$, $A_5$, $A_6$, $A_7$, $A_8$, and $A_9$ independently represent a hydrogen atom, —$C_nH_{2n+1}$ or —$(CH_2)_mX$ in which n is an integer of 1 to 3, m is an integer of 0 to 3 and X represents —COOM, $NH_2$ or —OH, and all of $A_1$, $A_2$, $A_3$, $A_4$, and $A_5$ are not simultaneously hydrogen atoms, or when B represents —OH or —$CH_2COOM$, $n_1$ and $n_2$ are integers satisfying $n_1+n_2=2$, $n_3$ is 0, $n_4$ is 1, $A_1$, $A_8$ and $A_9$ represent hydrogen atoms, $A_2$, $A_3$, $A_4$, and $A_5$ independently represent a hydrogen atom, —OH, —COOM, —$PO_3(M)_2$, —$CH_2COOM$, —$CH_2OH$ or a lower alkyl group and at least one of $A_2$, $A_3$, $A_4$, and $A_5$ represents —$CH_2COOM$, —COOM or —$PO_3(M)_2$; and M represents a hydrogen atom, an alkali metal atom or an ammonium group, Formula (II)

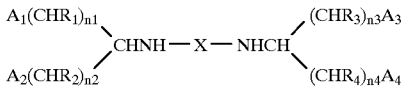

wherein $A_1$, $A_2$, $A_3$ and $A_4$ independently represent —COOM or —OH; $n_1$, $n_2$ $n_3$ and $n_4$ independently represent an integer of 0 to 2; $R_1$, $R_2$, $R_3$ and $R_4$ independently represent a hydrogen atom, —OH or a lower alkyl group; X represents an alkylene group having 2 to 6 carbon atoms or —$(B_1O)_m$—$B_2$— in which $B_1$ and $B_2$ independently represent an alkylene group having 1 to 5 carbon atoms, and m represents an integer of 1 to 5; and M represents a hydrogen atom, an alkali metal atom or an ammonium group, $Z^1$—$SM^1$ Formula (III)

wherein $Z^1$ represents an alkyl group, an aryl group or a heterocyclic group, provided that each group has, as a substituent, at least one selected from the group consisting of a hydroxy group, —$SO_3M_1$, —$COOM_1$ (in which $M_1$ represents a hydrogen atom, an alkali metal atom or a substituted or unsubstituted ammonium group), a substituted or unsubstituted amino group and a substituted or unsubstituted ammonio group or a substituent having at least one selected from the above mentioned group; $M^1$ represents a hydrogen atom, an alkali metal atom or a substituted or unsubstituted amidino group which may form a hydrogen halogenide salt or a sulfonic acid salt, (8) the method of item (7), wherein the content in the developer of the developing agent is 15 to 80 g per liter, the content in the developer of the third compound is $10^{-5}$ to $10^{-2}$ mol per liter, and the content ratio (molar ratio) of at least one of the first compound and the second compound to the third compound is 0.1:1 to 100:1, (9) the method of item (7), wherein the second compound is ethylenediamine-N,N'-disuccinic acid,

(10) the method of item (7), wherein the developer contains a developing agent, the third compound and ethylenediamine-N,N'-disuccinic acid,

(11) the method of item (7), wherein the material contains Ca in an amount of 0 to 15 mg/m$^2$,

(12) the method of item (11), wherein the material contains no calcium,

(13) the method of item (7), wherein the developer replenisher is prepared by dissolving in water first tablets containing the third compound and at least one of the first compound and the second compound and second tablets containing the developing agent,

(14) the method of item (7), wherein the developer replenisher is prepared by dissolving in water first tablets containing ethylenediamine-N,N'-disuccinic acid and second tablets containing the developing agent,

(15) the method of item (7), wherein the replenishing amount of the developer replenisher is 50 to 250 ml/m$^2$,

(16) the method of item (7), wherein 70% or more of the optical isomer of the first compound or the second compound are an [S, S] isomer, or

(17) the method of item (16), wherein 90% or more of the optical isomer of the first compound or the second compound are an [S, S] isomer.

The present invention will be detailed below.

In the invention, a black and white silver halide photographic light sensitive material (hereinafter referred to also as silver halide photographic light sensitive material) implies a silver halide photographic light sensitive material capable of forming a silver image by development to form a black and white image.

Now, compounds represented by Formula (1) or (II) will be explained.

Formula (1)

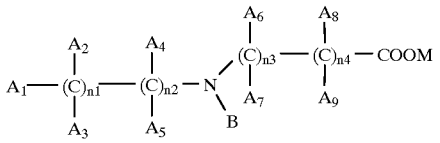

wherein B represents a hydrogen atom, —OH, or —$CH_2COOM$; provided that when B represents a hydrogen atom, $A_1$, $A_2$, $A_3$, $A_4$, $A_5$, $A_6$, $A_7$, $A_8$ and $A_9$ independently represent a hydrogen atom, —$C_nH_{2n+1}$ or —$(CH_2)_mX$ in which n is an integer of 1 to 3, m is an integer of 0 to 3, and X represents —COOM, $NH_2$ or —OH, and all of $A_1$, $A_2$, $A_3$, $A_4$ and $A_5$ are not simultaneously hydrogen atoms, or when B represents —OH or —$CH_2COOM$, $n_1$ and $n_2$ are integers satisfying $n_1+n_2=2$, $n_3$ is 0, $n_4$ is 1, $A_1$, $A_8$ and $A_9$ represent hydrogen atoms, $A_2$, $A_3$, $A_4$ and $A_5$ independently represent a hydrogen atom, —OH, —COOM, —$PO_3(M)_2$, —$CH_2COOM$, —$CH_2OH$ or a lower alkyl group (the lower alkyl group is preferably an alkyl group having 1 to 5 carbon atoms, for example, methyl, ethyl, iso-propyl, butyl or pentyl) and at least one of $A_2$, $A_3$, $A_4$ and $A_5$ represents —$CH_2COOM$, —COOM or —$PO_3(M)_2$; and M represents a hydrogen atom, an alkali metal atom or an ammonium group, Formula (II)

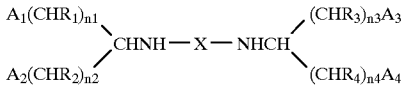

wherein $A_1$, $A_2$, $A_3$ and $A_4$ independently represent —COOM or —OH; $n_1$, $n_2$, $n_3$ and $n_4$ independently represent an integer of 0 to 2; $R_1$, $R_2$, $R_3$ and $R_4$ independently represent a hydrogen atom, —OH or a lower alkyl group (the lower alkyl group is preferably an alkyl group having 1 to 5 carbon atoms, for example, methyl, ethyl, iso-propyl, butyl or pentyl); X represents an alkylene group (for example, ethylene, propylene, butylene or hexylene) having 2 to 6 carbon atoms or —$(B_1O)_m$—$B_2$—in which $B_1$ and $B_2$ independently represent an alkylene group (for example, methylene, ethylene, propylene, butylene or pentylene) having 1 to 5 carbon atoms, and m represents an integer of 1 to 5; and M represents a hydrogen atom, an alkali metal atom or an ammonium group.

Exemplified compounds represented by Formula (I) or(II) are listed below, but the invention is not limited thereto.

I-1

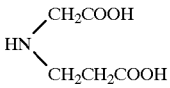

I-2

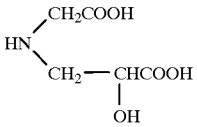

-continued

I-3

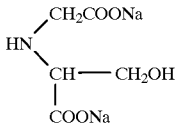

I-4

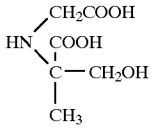

I-5

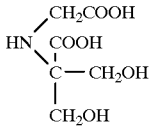

I-6

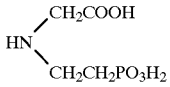

I-7

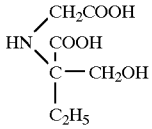

I-8

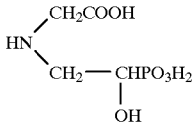

I-9

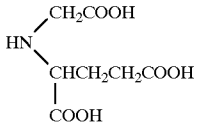

I-10

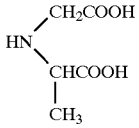

I-11

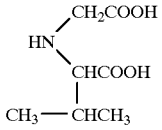

I-12

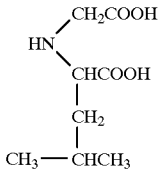

I-13

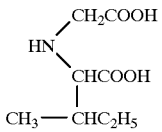

-continued
I-14
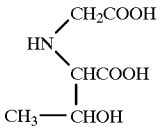
I-15
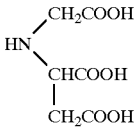
I-16
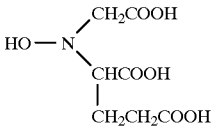
I-17
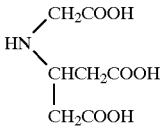
I-18
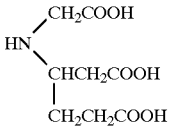
I-19
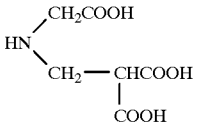
I-20
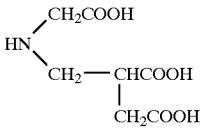
I-21
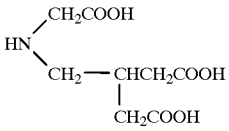
I-22
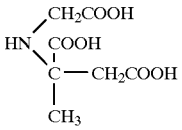
I-23
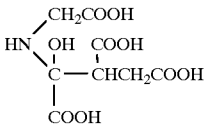
I-24
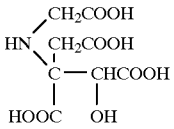
-continued
I-25
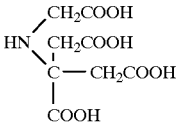
I-26
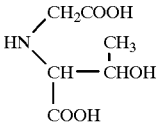
I-27
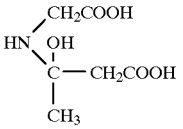
I-28
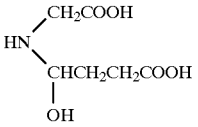
I-29
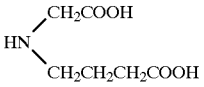
I-30
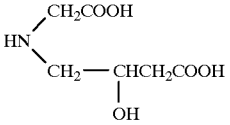
I-31
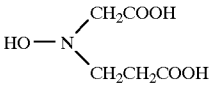
I-32
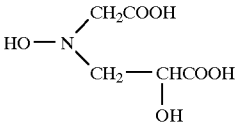
I-33
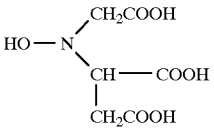
I-34
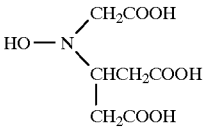
I-35
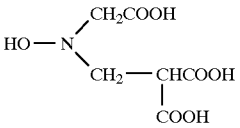

-continued
I-36
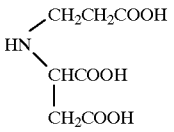
I-37
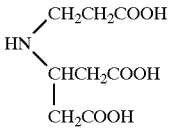
I-38
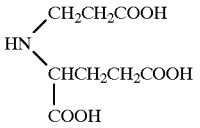
I-39
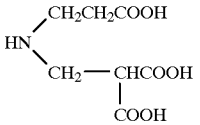
I-40
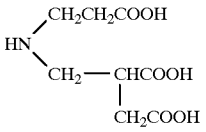
I-41
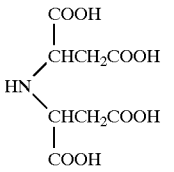
I-42
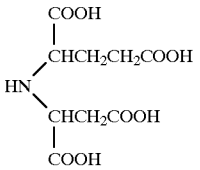
I-43
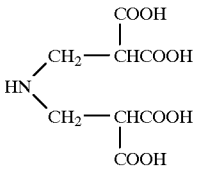
I-44
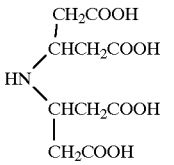
-continued
I-45
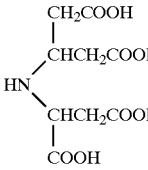
I-46
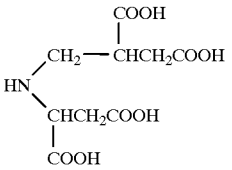
I-47
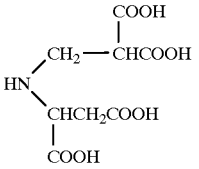
I-48
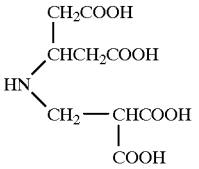
I-49
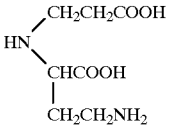
I-50
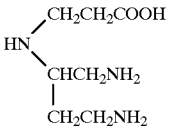
I-51
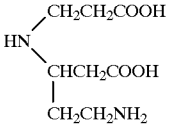
I-52
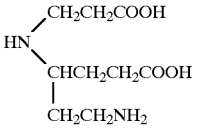
I-53
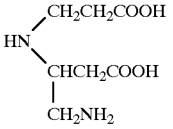
I-54
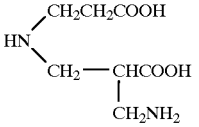

-continued
I-55
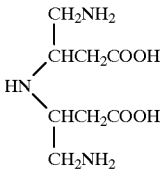
I-56
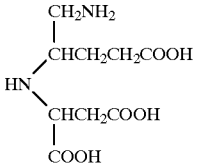
I-57
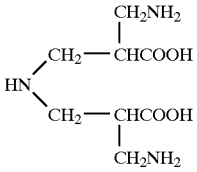
I-58
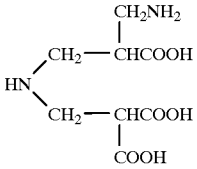
I-59
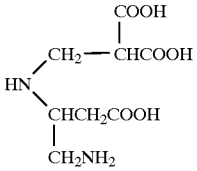
I-60
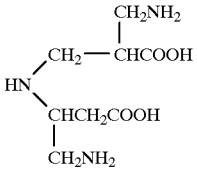
I-61
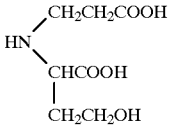
I-62
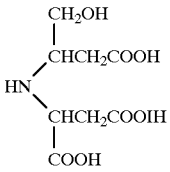
I-63
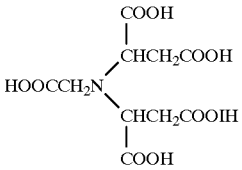
-continued
I-64
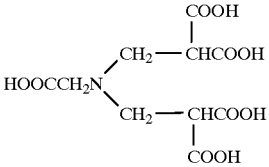
I-65
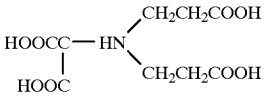
I-66
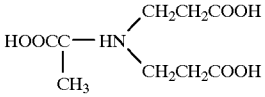
I-67
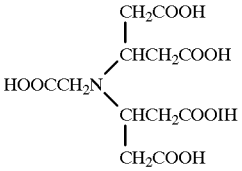
I-68
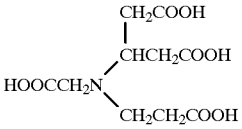
I-69
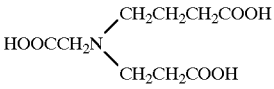
I-70
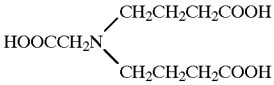
I-71
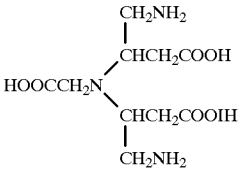
I-72
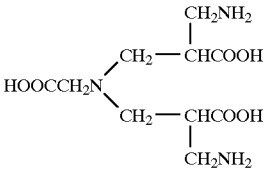
I-73
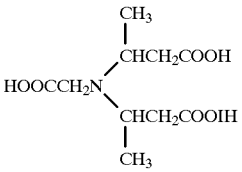

-continued
I-74
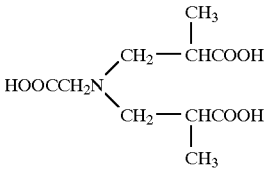
I-75
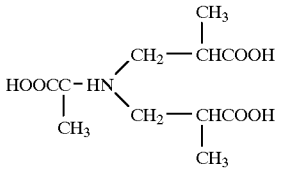
I-76
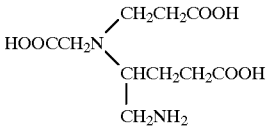
I-77
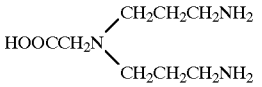
I-78
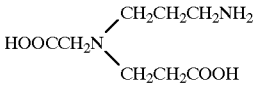
I-79
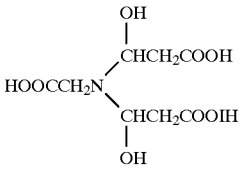
I-80
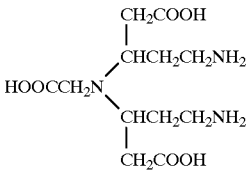
I-81
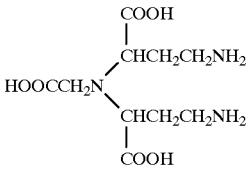
I-82
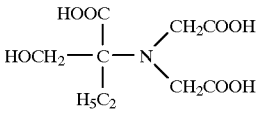
I-83
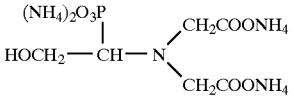
-continued
I-84
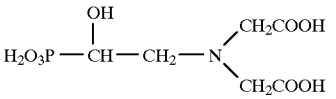
I-85
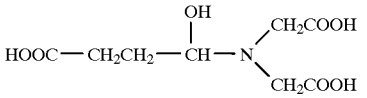
I-86
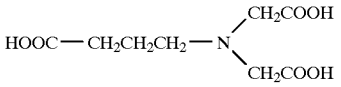
I-87
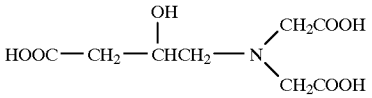
II-1
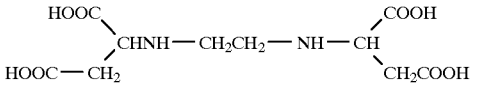
II-2
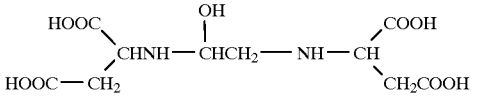
II-3
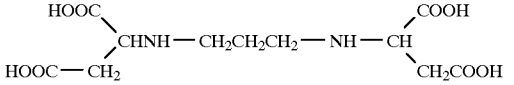
II-4
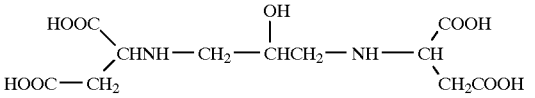
II-5
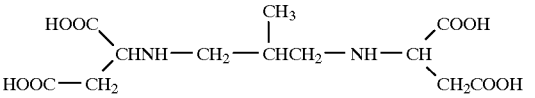
II-6
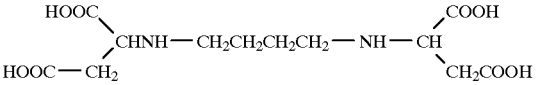
II-7
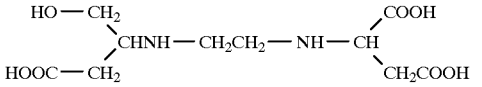
II-8
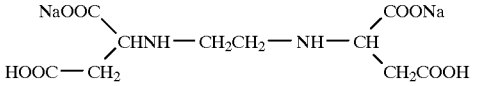
II-9
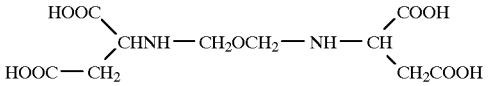
II-10
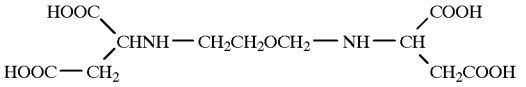

-continued

II-11

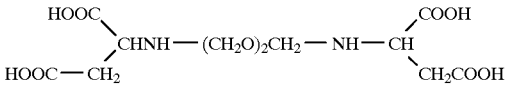

II-12

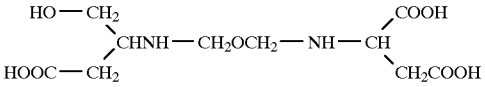

II-13

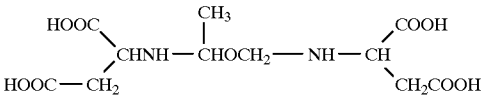

II-14

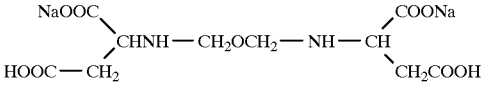

II-15

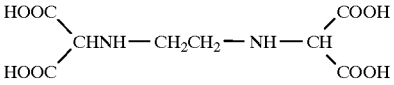

II-16

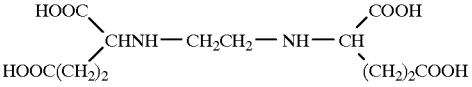

II-17

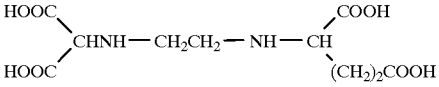

II-18

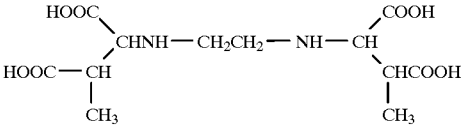

II-19

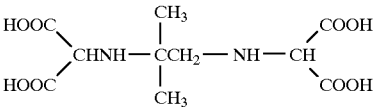

II-20

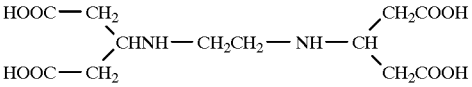

II-21

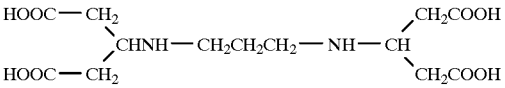

II-22

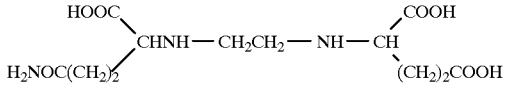

II-23

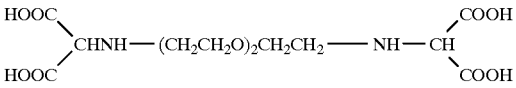

II-24

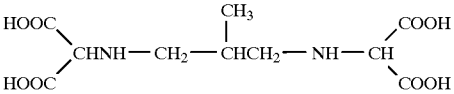

-continued

II-25

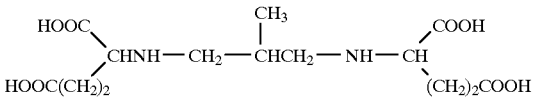

II-26

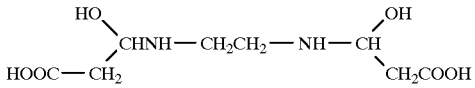

II-27

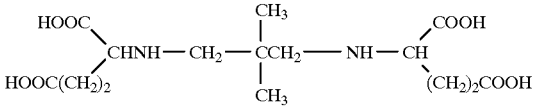

II-28

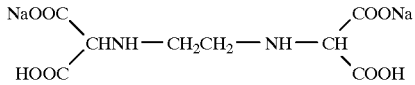

II-29

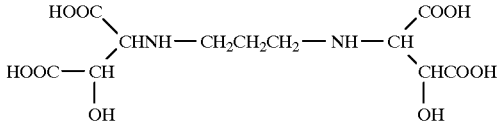

II-30

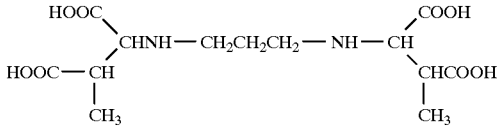

II-31

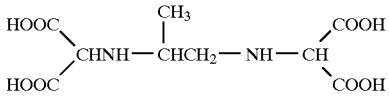

II-32

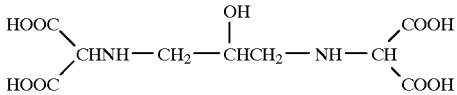

II-33

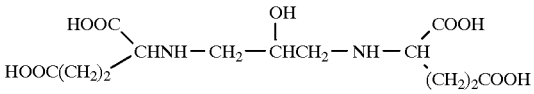

II-34

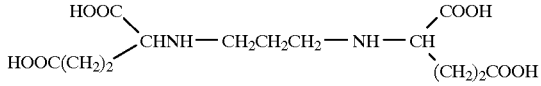

II-35

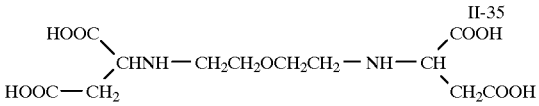

II-36

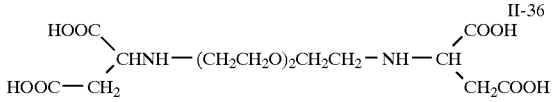

The content of the compound by represented by Formula (I) or (II) in a developer is preferably 0.01 to 50 g/liter, and more preferably 0.05 to 10 g/liter.

The compound by represented by Formula (I) or (II) may be any optical isomer, such as a [S, S] isomer, a [S, R] isomer, a [R, S] isomer, a [R, R] isomer, or a mixture thereof. For example, the isomer of Exemplified compound (II-1) may be a [S, S] isomer, a [S, R] isomer, a [R, R] isomer, or a mixture thereof as disclosed in a literature described later.

In the invention, a [S, S] isomer is selectively used, and the preferable is a compound prepared from an L-amino acid such as Exemplified compound (II-1). The [S, S] isomer is preferable in that it is easily biodegraded. The passage "a [S, S] isomer is selectively used" herein referred to implies that the isomer is a mixture of optical isomers containing the [S, S] isomer in an amount of not less than 70%, and preferably not less than 90%.

The compound by represented by Formula (I) is commercially available, and the compound by represented by Formula (II) can be synthesized according to methods disclosed in JP-A 63-199295 and 3-173857. The selective synthesis of a [S, S] isomer can be easily carried out according to a method disclosed in Umezawa etal., The JOURNAL OF ANTIBIOTICS, Volume XXXVII, No. 4, pp 426 (April, 1984).

In the invention, the developer or solid developer replenisher used for developing a black and white silver halide photographic light sensitive material preferably contains ethylenediamine-N,N'-disuccinic acid (Exemplified compound II-1, hereinafter referred to also as EDDS). Of isomers of EDDS, a [S, S] isomer is preferable.

Next, a compound represented by Formula (III) will be explained below.

The developer in the invention contains the compound represented by Formula (III).

In Formula (III), the alkyl group represented by $Z^1$ includes, preferably, an alkyl group having 1 to 30 carbon atoms and, particularly, a straight-chained, branched or cyclic alkyl group having 2 to 20 carbon atoms, which may have other substituents than the above-mentioned substituent. The aromatic group represented by $Z^1$ includes, preferably, a monocyclic or condensed ring having 6 to 32 carbon atoms, which may have other substituents than the above-mentioned substituent. The heterocyclic group represented by $Z^1$ is preferably a 5- or 6-membered ring having 1 to 6 of a hetero atom selected from the group consisting of nitrogen, oxygen and sulfur in one of the ring thereof which is a monocyclic or condensed ring having 1 to 32 carbon atoms. The compound represented by Formula (III) is preferably a compound in which $Z^1$ is a heterocyclic group containing one or more nitrogen atoms.

$Z^1$ has at least one selected from the group consisting of a hydroxy group, —$SO_3M_1$, —$COOM_1$, in which $M_1$ represents a hydrogen atom, an alkali metal atom or a substituted or unsubstituted ammonium group, a substituted or unsubstituted amino group and a substituted or unsubstituted ammonio group or a substituent having at least one selected from the above mentioned group. $M^1$ represents a hydrogen atom, an alkali metal atom or a substituted or unsubstituted amidino group (which may form a hydrogen halogenide salt or a sulfonic acid salt). The ammonio group preferably has, as a substituent, a substituted or unsubstituted straight-chained, branched or cyclic alkyl group such as a methyl group, an ethyl group, a benzyl group, an ethoxypropyl group or a cyclohexyl group, or a substituted or unsubstituted phenyl or naphthyl group, each having not more than 20 carbon atoms.

Of the compounds represented by Formula (III), the preferable compound is represented by the following Formula (IV):

Formula (IV)

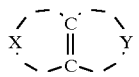

In Formula (IV), Z and Y independently represent an atomic group necessary to form an unsaturated 5- or 6-membered ring (for example, pyrrole, imidazole, pyrazole, pyrimidine and pyridazine), provided that three or more nitrogen atoms are contained in Z and Y and at least one of Z and Y has a mercapto group as a substituent. The compound represented by Formula (IV) may have a substituent other than a mercapto group, including, for example, a halogen atom (such as fluorine, chlorine and bromine), a lower alkyl group (including those having a substituent and preferably, those having not more than 5 carbon atoms such as a methyl group and an ethyl group), a lower alkoxy group (including those having a substituent and preferably, those having not more than 5 carbon atoms such as methoxy, ethoxy and butoxy), a hydroxy group, a sulfo group, a lower allyl group (including those having a substituent and preferably, those having not more than 5 carbon atoms), an amino group, a —$COOM_2$ group (in which $M_2$ represents a hydrogen atom, an alkali-metal atom or a substitute d or unsubstituted ammonium group), a carbamoyl group and a phenyl group. The substituent is particularly preferably a hydroxy group, a —$COOM_2$ group (in which $M_2$ represents a hydrogen atom, an alkali-metal atom or a substituted or unsubstituted ammonium group), an amino group or a sulfo group. In Formula (IV), the compounds represented by the following Formulas A through F are particularly preferable.

Formula A

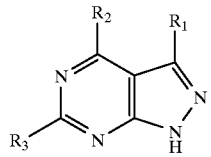

Formula B

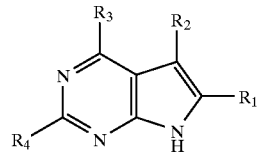

Formula C

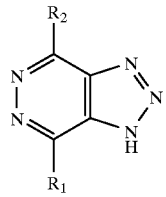

-continued

Formula D

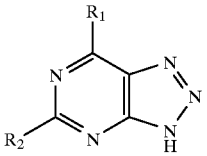

Formula E

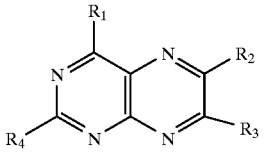

Formula F

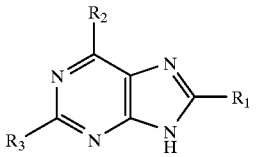

In Formulas A and F, $R_1$, $R_2$ and $R_3$ independently represent a hydrogen atom, a halogen atom, a substituted or unsubstituted lower alkyl group having 1 to 5 carbon atoms (such as a methyl group or an ethyl group), a substituted or unsubstituted lower alkenyl group having 2 to 5 carbon atoms, a substituted or unsubstituted lower alkoxy group having 1 to 5 carbon atoms, a phenyl group, —$SM_1$, a hydroxy group, —$COOM_2$, —$SO_3M_3$, a substituted or unsubstituted amino group, a substituted or unsubstituted ammonium group, or a carbamoyl group, provided that at least one of $R_1$, $R_2$ and $R_3$ is —$SM_1$, and at least one of the rest is a group selected from the group consisting of a hydroxy group, —$COOM_2$, —$SO_3M_3$, a substituted or unsubstituted amino group and a substituted or unsubstituted ammonium group, in which $M_1$, $M_2$ and $M_3$ may be the same or different, and independently represent a hydrogen atom, an alkali metal atom or a substituted or unsubstituted ammonium group.

In Formulas B and E, $R_1$, $R_2$, $R_3$ and $R_4$ independently represent a hydrogen atom, a halogen atom, a substituted or unsubstituted lower alkyl group having 1 to 5 carbon atoms (such as a methyl group or an ethyl group), a substituted or unsubstituted lower alkenyl group having 2 to 5 carbon atoms, a substituted or unsubstituted lower alkoxy group having 1 to 5 carbon atoms, a phenyl group, —$SM_1$, a hydroxy group, —$COOM_2$, —$SO_3M_3$, a substituted or unsubstituted amino group, a substituted or unsubstituted ammonium group, or a carbamoyl group, provided that at least one of $R_1$, $R_2$, $R_3$ and $R_4$ is —$SM_1$, and at least one of the rest is a group selected from the group consisting of a hydroxy group, —$COOM_2$, —$SO_3M_3$, a substituted or unsubstituted amino group and a substituted or unsubstituted ammonium group, in which $M_1$, $M_2$ and $M_3$ may be the same or different, and independently represent a hydrogen atom, an alkali metal atom or a substituted or unsubstituted ammonium group.

In Formulas C and D, $R_1$ and $R_2$ independently represent a hydrogen atom, a halogen atom, a substituted or unsubstituted lower alkyl group having 1 to 5 carbon atoms (such as a methyl group or an ethyl-group), a substituted or unsubstituted lower alkenyl group having 2 to 5 carbon atoms, a substituted or unsubstituted lower alkoxy group having 1 to 5 carbon atoms, a phenyl group, —$SM_1$, a hydroxy group, —$COOM_2$, —$SO_3M_3$, a substituted or unsubstituted amino group, a substituted or unsubstituted ammonium group, or a carbamoyl group, provided that one of $R_1$ and $R_2$ is —$SM_1$, and the other of $R_1$ and $R_2$ is a group selected from the group consisting of a hydroxy group, —$COOM_2$, —$SO_3M_3$, a substituted or unsubstituted amino group and a substituted or unsubstituted ammonium group, in which $M_1$, $M_2$ and $M_3$ may be the same or different, and independently represent a hydrogen atom, an alkali metal atom or a substituted or unsubstituted ammonium group.

The substituent of the amino group or the ammonium group described above is preferably an alkyl group having 1 to 5 carbon atoms. The ammonium group is preferably an unsubstituted ammonium group.

The concrete examples of the compounds represented by Formula (III) will be given below. However, the invention shall not be limited thereto.

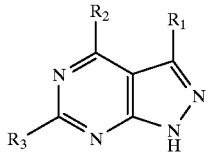

| | $R_1$ | $R_2$ | $R_3$ |
|---|---|---|---|
| S-1 | H | OH | SH |
| S-2 | H | SH | OH |
| S-3 | OH | H | SH |
| S-4 | OH | H | SH |
| S-5 | H | $NH_2$ | SH |
| S-6 | H | SK | $SO_3K$ |
| S-7 | COOH | H | SH |

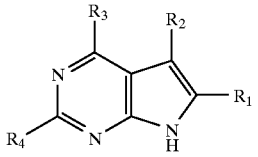

| | $R_1$ | $R_2$ | $R_3$ | $R_4$ |
|---|---|---|---|---|
| S-8 | H | H | OH | SH |
| S-9 | Cl | H | $NH_2$ | SH |
| S-10 | SH | H | $NH_2$ | H |
| S-11 | H | H | COOH | SH |
| S-12 | OH | H | H | SH |
| S-13 | H | H | OH | SH |
| S-14 | SH | H | SH | $SO_3H$ |

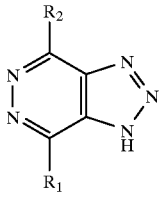

| | $R_1$ | $R_2$ |
|---|---|---|
| S-15 | SH | OH |
| S-16 | $NH_2$ | SH |
| S-17 | SH | COOH |
| S-18 | SH | $SO_3H$ |
| S-19 | SH | OH |

-continued

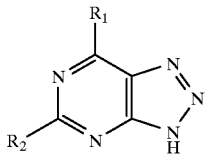

| | $R_1$ | $R_2$ |
|---|---|---|
| S-20 | SH | COOH |
| S-21 | $NH_2$ | SH |
| S-22 | SH | COOH |
| S-23 | SH | $SO_3H$ |
| S-24 | SH | OH |

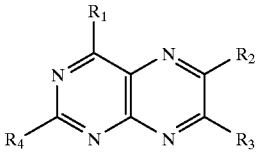

| | $R_1$ | $R_2$ | $R_3$ | $R_4$ |
|---|---|---|---|---|
| S-25 | $NH_2$ | H | H | SH |
| S-26 | COOH | H | SH | SH |
| S-27 | OH | H | H | SH |
| S-28 | H | $NH_2$ | H | SH |
| S-29 | SH | COOH | H | H |
| S-30 | H | H | $SO_3H$ | SH |

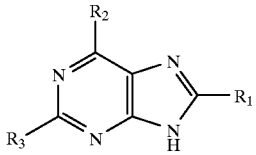

| | $R_1$ | $R_2$ | $R_3$ |
|---|---|---|---|
| S-31 | SH | OH | H |
| S-32 | SH | H | COOH |
| S-33 | H | OH | SH |
| S-34 | $SO_3H$ | SH | SH |
| S-35 | H | SH | $SO_3H$ |
| S-36 | $NH_2$ | H | SH |
| S-37 | $NH_2$ | SH | H |
| S-38 | H | $NH_2$ | SNa |
| S-39 | SH | $NH_2$ | H |

In the invention, a developer for a black and white silver halide photographic light sensitive material or a solid developer replenisher to be replenished in the developer preferably contains 8-mercaptoadenine (Exemplified compound S-39 described above).

The content in the developer of the compound represented by Formula (III) is preferably $10^{-6}$ to $10^{-1}$ mol per liter, and more preferably $10^{-5}$ to $10^{-2}$ mol per liter.

In the method of the invention, the content ratio (by mole) of the compound represented by Formula (I) or (II) and the compound represented by Formula (III) is preferably 0.1:1 to 100:1, and more preferably 1:1 to 50:1.

The black and white silver halide photographic light sensitive material or developer used in the invention may contain calcium.

The compounds providing calcium which may be contained in the light sensitive material or the developer include calcium halide such as calcium chloride, calcium bromide or calcium iodide, an inorganic calcium compound such as calcium hydroxide, calcium hydrogen carbonate, calcium dihydrogenphosphate, calcium sulfide or calcium thiosulfate, an organic calcium compound such as calcium acetate, calcium benzoate, calciumlactate or calcium citrate. These can be used singly or in combination thereof. These can be added to a silver halide emulsion coating solution or a non-silver halide emulsion gelatin coating solution.

The water soluble compounds of these compounds are dissolved in a water, but the water insoluble compounds of these compounds may be dispersed in water or may be dissolved in an organic solvent such as an alcohol (for example, methanol or fluorinated alcohol, ether, benzene, toluene, dimethylsulfoxide (DMSO) or tetrahydrofuran (THF).

The calcium content of a light sensitive material may be adjusted by controlling a calcium amount contained in gelatin. A method of controlling a calcium amount contained in gelatin include (1) a method to employ gelatin containing calcium in a small amount on preparing the light sensitive material or (2) a method to employ, on preparing the light sensitive material, a gelatin-containing coating such as a gelatin solution, an emulsion or a silver halide emulsion, which has been desalted by noodle washing or dialyzing.

Of the above methods, the method (1) is preferable. The calcium content of the lime-processed gelatin is not less than 1000 ppm, and a deionized gelatin containing less calcium (calcium of not more than 100 ppm) can be obtained by treating gelatin with a $Na^+$ type or $H^+$ type cation exchange resin. The gelatin having a less calcium content, which is treated by a treating method such as dialysis, can be employed in the invention.

In the invention, the calcium content of gelatin is preferably adjusted by adding a water soluble calcium salt, and the water soluble calcium salt is preferably a calcium halide, which provides a big effect.

In the invention, the calcium content of the light sensitive material is preferably 0 to 15 $mg/m^2$, and most preferably 0 $mg/m^2$.

The starting developer can be obtained by diluting a concentrated developer kit ordinarily used with water, or by dissolving in water a solid processing composition for developer containing two kinds or more ingredients, singly or in combination thereof. The developer replenisher is preferably obtained by dissolving in water a solid developer composition containing two kinds or more ingredients, singly or in combination thereof.

The developer includes a solution containing hydroquinone, ascorbic acid, erysorbic acid or derivatives thereof as a developing agent. The developing agent is preferably hydroquinone, ascorbic acid, or erysorbic acid, and more preferably a mixture of hydroquinone with ascorbic acid or erysorbic acid in view of its storage stability or photographic performance. The hydroquinone content of developer is preferably 15 to 40 g per liter, and the ascorbic acid or erysorbic acid content of developer is preferably 40 to 80 g per liter. The pH of a hydroquinone containing developer is preferably 10.0 to 11.0, and more preferably 10.3 to 10.8, and the pH of an ascorbic acid or erysorbic acid containing developer is preferably 9.5 to 10.5, and more preferably 9.7 to 10.2.

The starting fixer can be obtained by diluting a concentrated fixer kit ordinarily used with water, or by dissolving in water a solid processing composition for fixer containing two kinds or more ingredients, singly or in combination thereof.

The fixer includes a solution containing a thiosulfate, and the pH of the starting fixer is 4.0 or more, preferably 4.2 to 5.5, and more preferably 4.6 to 5.3. The fixing agent includes sodium thiosulfate and ammonium thiosulfate. The fixer contains a thiosulfate ion as an essential component, and ammonium thiosulfate is especially preferable in view of fixing speed. The content in the fixer of the fixing agent is optionally varied, but is generally 0.1 to about 6 mol/liter.

The fixer may contain a water soluble aluminum salt as a hardener, for example, aluminum sulfate or potash alum. The fixer may optionally contain a preserver (for example, a sulfite or a bisulfite), a pH adjusting agent (for example, sulfuric acid or sodium hydroxide), a chelating agent capable of softening a hard water or compounds disclosed in JP-A-62-78551.

In the processing method of the invention, the developer and fixer are preferably replenished with developer replenisher and fixer replenisher, respectively. The composition of the developer replenisher and fixer replenisher to be replenished may be the same as, or different from, the developer and fixer, respectively.

In the invention, the solid processing composition implies a solid containing two or more ingredients to be contained in a processing solution. The solid processing composition may be a single solid containing all the ingredients to be contained in a processing solution or may be comprised of two or more solids containing in combination thereof all the ingredients to be contained in a processing solution. The solid processing composition is comprised of at least one solid containing at least two ingredients, and the ingredients other than the solid processing composition may be single compounds.

In order to minimize a waste solution, a light sensitive material is processed while a specific amount of a processing replenisher is replenished in proportion to an area of the light sensitive material to be processed. The replenishing amount of developer replenisher is 200 ml or less, preferably 50 to 190 ml per $m^2$ of light sensitive material. The replenishing amount of fixer replenisher is 250 ml or less, preferably 50 to 190 ml per $m^2$ of light sensitive material.

The replenishing amounts of the developer and fixer replenisher herein referred to is a replenishing amount. When the mother developer and fixer developer are replenished, the replenishing amount is a replenishing amount thereof. When a concentrated developer and its diluting water, and a concentrated fixer and its diluting water are replenished, the replenishing amount is a total replenishing amount of the concentrated developer and its diluting water, and a total replenishing amount of a concentrated fixer and its diluting water. When a processing solution in which a solid processing composition is dissolved in water is replenished, the replenishing amount is a total volume of the solid processing composition and water. When a solid processing composition and water is separately replenished, the replenishing amount is a total volume of the solid processing composition and water. When a solid processing composition is directly replenished in a processing tank of an automatic processor, the replenishing amount is preferably represented in terms of a total volume of the solid processing composition and water separately replenished. The developer replenisher and fixer replenisher may be the same as or different from a mother developer in the developer tank and a fixer developer in the fixer tank in an automatic processor, or may be also a solid developer or solid fixer.

The solid processing composition amount per time to be incorporated in the processing solution is preferably 0.1 to 50 g. The amount of the solid developer composition is preferably 1 to 20 g per time of incorporation, and the amount of the solid fixer composition is preferably 5 to 50 g per time of incorporation. When processing is carried out employing a compact automatic processor while the solid processing composition is incorporated in this amount into the processing solution of the processor and slowly dissolved, the processing does not have much influence on the resulting photographic properties. Even if a large amount of the solid processing composition is incorporated one time in the solution, the amount of ingredients dissolved in the processing solution and the amount of ingredients in the processing solution consumed by light sensitive material to be processed are balanced, since the solid processing composition is gradually dissolved in the processing solution. It has been proved that stable photographic properties can also be obtained by replenishing water for replenishment in accordance with dissolution of the solid processing composition. The processing solution is constantly kept at a given processing temperature. Therefore, the dissolution speed is quite constant, and as a result, a balance is always maintained between the amount of solid processing composition to be incorporated and the amount of the ingredients contained in the processing solution.

The temperatures of developer, fixer, washing and stabilizing bath are preferably from 10° C. to 45° C., and may be adjusted separately.

In view of rapid processing, when light sensitive material is processed using an automatic developing apparatus, the total processing time (Dry to Dry processing time) is preferably 10–60 seconds, and more preferably 15–50 seconds. The total processing time is the time taken from the entry of the leading edge of the light sensitive material in the apparatus to the delivery of the trailing end of the light sensitive material out of the drying zone of the apparatus. Dry to Dry processing time is more preferably 25 to 120 seconds. In order to running process stably 10 $m^2$ or more of light sensitive material, developing time is preferably 2–18 seconds.

The automatic developing apparatus preferably comprises a drying zone in which heat conductors of 60° C. or more (for example, a heat roller of 60–130° C. or more) or heat radiation materials of 150° C. or more (for example, a material such as tungsten, carbon, nichrome, zirconium oxide.yttrium oxide.thorium mixture or silicon carbide emitting an infrared light by applying electric current or a heat heat conductor such as copper, stainless steel, nickel, or ceramics heated by transfer of heat from heat radiation materials) are provided.

The automatic developing apparatus employing the following method or the following mechanism is preferably used.

(1) Deodorizing device: JP-A 64-37560, pp. 544 (2), left upper column to pp. 545 (3), left upper column.
(2) Regenerating and cleaning agent for washing water and its device: JP-A 6-250352, pp. 3 (0011) to pp. 8 (0058).
(3) Waste liquor-treatment method: JP-A 2-64638, pp. 388 (2), left lower column to pp. 391 (5) left lower column.
(4) Rinsing bath between a developing bath and fixing bath: JP-A 4-313749, pp. 18 (0054) to 21 (0065).
(5) Water-replenishing method: JP-A 1-281446, pp. 250 (2), left lower column to right lower column.
(6) Method for controlling drying air of a processor by detecting outdoor temperature and humidity: JP-A 1-315745 pp. 496(2) right lower column to 501 (7) right lower column, JP-A 2-108051, pp. 588 (2), left column to pp. 589 (3) left lower column.
(7) Method for silver recovery from fixer effluent: JP-A 6-27623 pp. 4 (0012) to 7 (0071).

The silver halide composition used in the black and white silver halide photographic light sensitive material in the invention is preferably silver chloride, or silver bromochloride or bromoiodochloride having a silver chloride content of 60 mol % or more, when processed with reduced replenishment of a processing solution or rapidly processed.

The average grain size of the silver halide grains is preferably not more than 1.2 μm, and more preferably not more than 0.8 to 0.1 μm. The grain size distribution is preferably narrow, and the silver halide emulsion is preferably so-called a monodisperse emulsion. The silver halide grains are preferably tabular grains having a major face (100), which are disclosed in U.S. Pat. Nos. 5,264,337, 5,314,798 and 5,320,958, and can be easily obtained. In order to obtain high intensity properties, the silver halide grains are preferably doped with iridium in an amount of $10^{-9}$ to $10^{-3}$ mol per mol of silver halide, and in order to obtain a high contrast emulsion, the silver halide grains are preferably doped with rhodium, ruthenium, osmium or rhenium in an amount of $10^{-9}$ to $10^{-3}$ mol per mol of silver halide.

The silver halide emulsion can be chemically sensitized with sulfur sensitization, selenium sensitization, tellurium sensitization, reduction sensitization or gold sensitization.

The black and white silver halide photographic light sensitive material processed employing the method of the invention preferably comprises the techniques described below.

1) Dye particles dispersed in a solid form JP-A 7-5629, pp. 3, (0017) to pp. 16, (0042).
2) Acid group containing compounds JP-A 62-237445, pp. 292 (2), lower left column, line 11 to pp. 309 (25), lower right column, line 3.
3) Acid polymer JP-A 6-186659, pp. 10, (0036) to pp. 17, (0062).
4) Sensitizing dyes JP-A 5-224330, pp. 3, (0017) to pp. 13, (0040). JP-A 6-194771, pp. 11, (0042) to pp. 22, (0094). JP-A 6-337492, pp. 3, (0012) to pp. 34, (0056). JP-A 6-242533, pp. 2, (0015) to pp. 8, (0034). JP-A 6-337494, pp. 4, (0013) to pp. 14, (0039).
5) Super sensitizing dyes JP-A 6-347938, pp. 3, (0011) to pp. 16, (0066).
6) Hydrazine derivatives JP-A 7-114126, pp. 23, (0111) to pp. 32, (0157).
7) Nucleation accelerating agent JP-A 7-114126, pp. 32, (0158) to pp. 36, (0169).
8) Tetrazolium compounds JP-A 6-208188, pp. 8,(0059) to pp. 10, (0067).
9) Pyridinium compounds JP-A 7-110556, pp. 5, (0028) to pp. 29, (0068).
10) Redox compounds JP-A 4-245243, pp. 235 (7) to pp. 250 (22).
11) Syndiotactic polystyrene support JP-A 3-131843, pp. 324 (2) to pp. 327 (5).

Other additives, which can be used, are disclosed, for example, in Research Disclosure No. 17643 (December, 1978), Research Disclosure No. 18716 (November, 1979) and Research Disclosure No. 308119 (December, 1989).

EXAMPLES

The Examples of the present invention will be detailed below, but not limited thereto.

Example 1

(Preparation of silver halide emulsion A)

Silver bromochloride core grains comprised of 70 mol % of silver chloride and silver bromide, which had an average thickness of 0.05 μm and an average diameter of 0.15 μm, were prepared in a double-jet precipitation method. In the process $K_3RuCl_6$ was added in an amount of $8\times10^{-8}$ mol/mol of silver. The shell was formed on the core in a double-jet precipitation method, while $K_2IrCl_6$ was added in an amount of $3\times10^{-7}$ mol/mol of silver. The resulting emulsion was proved to be an emulsion comprising tabular core/shell type monodisperse (a variation coefficient of 10%) silver bromoiodochloride grains (comprised of 90 mol % of silver chloride, 0.2 mol % of silver iodide and silver bromide) with a (100) face as a main plane, having an average thickness of 0.10 μm and an average diameter of 0.25 μm.

To the resulting emulsion were 1800 ml of a 13.8 weight % denatured gelatin aqueous solution as a polymer coagulant, and stirred for 3 minutes. herein, the denatured gelatin was a gelatin in which the amino group was substituted with a phenylcarbamyl group (substitution ratio of 90%). The resulting mixture was adjusted to pH 4.6 with an aqueous acetic acid 56 weight % solution, stirred for 3 minutes and then allowed to stand for 30 minutes. Thereafter, the supernatant was decanted.

To the resulting emulsion were added 9.0 liters of distilled water, and stirred, allowed to stand and the supernatant was decanted. Further, to the resulting emulsion were added 1.25 liters of distilled water, and stirred, allowed to stand and the supernatant was decanted. The resulting emulsion was then added with an aqueous gelatin solution and an aqueous 10 weight % sodium carbonate solution to adjust to pH 5.80, and stirred at 50° C. for 30 minutes to redisperse. After the redispersion, the emulsion was adjusted to pH 5.80 and pAg 8.06 at 50° C. The resulting EAg after the desalting was 190 mv at 50° C.

To the emulsion was added $1\times10^{-3}$mol per mol of silver of 4-hydroxy-6-methyl-1,3,3a,7-tetrazaindene. Potassium bromide and citric acid were added, and adjusted to be pH 5.6 and EAg 123 mv. To the emulsion were added $1\times10^{-3}$ mol/mol of p-toluenethiosulfonic acid silver of chloroauric acid and then 350 mg/mol of silver of chloramin T, 0.6 mg/mol of silver of inorganic sulfur ($S_8$), and the mixture was chemically ripened at 60° C. to obtain a maximum sensitivity. After the ripening, $2\times10^{-3}$ mol per mol of silver of 4-hydroxy-6-methyl-1,3,3a,7-tetrazaindene, $3\times10^{-4}$ mol per mol of silver of 1-phenyl-5-mercaptotetrazole and 300 mg of potassium iodide were added to the emulsion to obtain silver halide emulsion A.

(Preparation of silver halide emulsion B)

Silver iodobromochloride core grains comprised of 60 mol % of silver chloride, 2.5 mol % of silver iodide and silver bromide, which had an average thickness of 0.05 μm and an average diameter of 0.15 μm, were prepared in a double-jet precipitation method. In the process, $K_3Rh(H_2O)Br_6$ was added in an amount of $2\times10^{-8}$ mol/mol of silver. The shell was formed on the core in a double-jet precipitation method, while $K_2IrCl_6$ was added in an amount of $3\times10^{-7}$ mol/mol of silver. The resulting emulsion was proved to be an emulsion comprising tabular core/shell type monodisperse (a variation coefficient of 10%) silver bromoiodochloride grains (comprised of 90 mol % of silver chloride, 0.5 mol % of silver iodide and silver bromide), having an average thickness of 0.10 μm and an average diameter of 0.42 μm. Thereafter, the emulsion was desalted with denatured gelatin disclosed in Japanese Patent O.P.I. Publication No. 2-280139/1990 (one in which an amino group in gelatin is substituted with a phenylcarbamyl group, for example, Exemplified compound G-8 on page 287(3) in JP-A 2-280139. The resulting EAg after the desalting was 190 mv at 50° C.

To the emulsion was added $1\times10^{-3}$ mol per mol of silver of 4-hydroxy-6-methyl-1,3,3a,7-tetrazaindene. Potassium bromide and citric acid were added, and adjusted to be pH 5.6 and EAg 123 mv. To the emulsion were added $2\times10^{-5}$ mol/mol of silver of chloroauric acid and $3\times10^{-5}$ mol/mol of silver of N,N,N'-trimethyl-N'-heptafluoroselenourea and the mixture was chemically ripened at 60° C. to obtain a maximum sensitivity. After the ripening, $2\times10^{-3}$ mol per mol of silver of 4-hydroxy-6-methyl-1,3,3a,7-tetrazaindene, $3\times10^{-4}$ mol per mol of silver of 1-phenyl-5-mercaptotetrazole and gelatin were added to the emulsion to obtain silver halide emulsion B.

(Preparation of silver halide photographic light-sensitive material for graphic arts for He—Ar laser light)

On one subbing layer surface of a subbed support were simultaneously coated using an extrusion coater the following gelatin layer composition, Prescription 1 in an amount of 0.5 g/m$^2$, the following silver halide emulsion 1 composition, Prescription 2 in an amount of 2.9 g/m$^2$ of silver and of 0.5 g/m$^2$ of gelatin, the following intermediate layer composition, Prescription 3 in an amount of 0.3 g/m$^2$ of gelatin, the following silver halide emulsion 2 composition, Prescription 4 in an amount of 0.2 g/m$^2$ of silver and of 0.4 g/m$^2$ of gelatin, and the following protective layer composition, Prescription 5 in an amount of 0.6 g/m$^2$ of gelatin, in that order. On the subbing layer surface of the support opposite the emulsion layer were simultaneously coated the following backing layer composition, Prescription 6 in an amount of 0.6 g/m$^2$ of gelatin, the following polymer layer composition, Prescription 7, and the following backing protective layer composition, Prescription 8 in an amount of 0.4 g/m$^2$ of gelatin, in that order. Thus, silver halide photographic light sensitive material sample was prepared.

Prescription 1 (gelatin subbing layer composition)

| | | |
|---|---|---|
| Gelatin | 0.5 | g/m$^2$ |
| Solid dispersion particles of AD-1 (Average diameter 0.1 μm) | 25 | g/m$^2$ |
| Polystyrene sodium sulfonate (Average molecular weight 500,000) | 10 | mg/m$^2$ |
| Compound S-1 | 0.4 | mg/m$^2$ |

Prescription 2 (silver halide emulsion layer 1 composition)

| | | |
|---|---|---|
| Silver halide emulsion A | 1.5 | g/m$^2$ (in terms of silver) |
| Solid dispersion particles of Dye a (Average diameter 0.1 μm) | 20 | mg/m$^2$ |
| Cyclodextrin (hydrophilic polymer) | 0.5 | g/m$^2$ |
| Sensitizing Dye d-1 | 5 | mg/m$^2$ |
| Sensitizing Dye d-2 | 5 | mg/m$^2$ |
| Hydrazine derivative HY-1 | 20 | mg/m$^2$ |
| Nuclear accelerating agent AM-1 | 40 | mg/m$^2$ |
| Redox compound RE-1 | 20 | mg/m$^2$ |
| Compound e | 100 | mg/m$^2$ |
| Latex polymer f | 0.5 | g/m$^2$ |
| Hardener g | 5 | mg/m$^2$ |
| Compound S-1 | 0.7 | mg/m$^2$ |
| 2-Mercapto-6-hydroxypurine | 5 | mg/m$^2$ |
| Ethylenediamine tetraacetic acid | 30 | mg/m$^2$ |
| Colloidal silica (average diameter 0.05 μm) | 10 | mg/m$^2$ |

Prescription 3 (intermediate layer composition)

| | | |
|---|---|---|
| Gelatin | 0.3 | g/m$^2$ |
| Compound S-1 | 2 | mg/m$^2$ |

Prescription 4 (silver halide emulsion layer 2 composition)

| | | |
|---|---|---|
| Silver halide emulsion B | 1.4 | g/m$^2$ (in terms of silver) |
| Sensitizing Dye d-1 | 3 | mg/m$^2$ |
| Sensitizing Dye d-2 | 3 | mg/m$^2$ |
| Hydrazine derivative HY-2 | 20 | mg/m$^2$ |
| Nuclear accelerating agent AM-1 | 40 | mg/m$^2$ |
| Redox compound RE-1 | 20 | mg/m$^2$ |
| 2-Mercapto-6-hydroxypurine | 5 | mg/m$^2$ |
| Ethylenediamine tetraacetic acid | 20 | mg/m$^2$ |
| Latex polymer f | 0.5 | g/m$^2$ |
| Compound S-1 | 1.7 | mg/m$^2$ |

Prescription 5 (emulsion protective layer composition)

| | | |
|---|---|---|
| Gelatin | 0.6 | g/m$^2$ |
| Solid dispersion particles of Dye b (Average diameter 0.1 μm) | 40 | mg/m$^2$ |
| Compound S-1 | 12 | mg/m$^2$ |
| Matting agent, Monodispersed silica (an average diameter 3.5 μm) | 25 | mg/m$^2$ |
| 1,3-Vinylsulfonyl-2-propanol | 40 | mg/m$^2$ |
| Surfactant h | 1 | mg/m$^2$ |
| Colloidal silica (Average diameter 0.05 μm)) | 10 | mg/m$^2$ |
| Hardener j | 30 | mg/m$^2$ |
| $CaCl_2$ | Amount as shown in Table 1 | |

Prescription 6 (backing layer composition)

| | | |
|---|---|---|
| Gelatin | 0.6 | g/m$^2$ |
| Compound S-1 | 5 | mg/m$^2$ |
| Latex polymer f | 0.3 | g/m$^2$ |
| Colloidal silica (average diameter 0.05 μm) | 70 | mg/m$^2$ |
| Polystyrene sodium sulfonate | 20 | mg/m$^2$ |
| Compound i | 100 | mg/m$^2$ |
| $CaCl_2$ | Amount as shown in Table 1 | |

Prescription 7 (hydrophobic polymer layer composition)

| | | |
|---|---|---|
| Latex (methylmethacrylate:acrylic acid = 97:3) | 1.0 | g/m$^2$ |
| Hardener g | 6 | mg/m$^2$ |

Prescription 8 (protective backing layer composition)

| | | |
|---|---|---|
| Gelatin | 0.4 | g/m$^2$ |
| Matting agent, monodispersed polymethyl methacrylate (an average diameter of 5 μm) | 50 | mg/m$^2$ |
| Sodium-di-(2-ethylhexyl)sulfosuccinate | 10 | mg/m$^2$ |
| Surfactant h | 1 | mg/m$^2$ |
| Dye k | 20 | mg/m$^2$ |
| $H—(OCH_2OCH_2)_{68}—OH$ | 50 | mg/m$^2$ |
| Hardener j | 20 | mg/m$^2$ |

AD-1
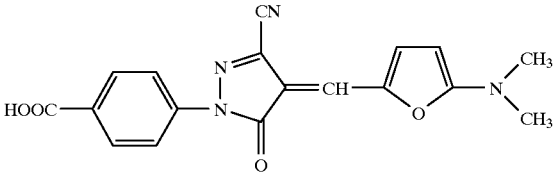
Compound S-1
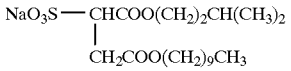
Dye a
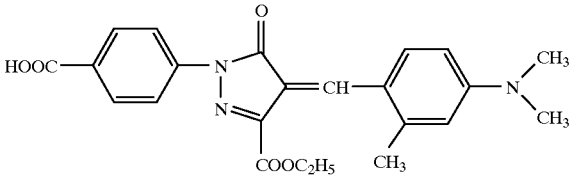
Sensitizing dye d-1
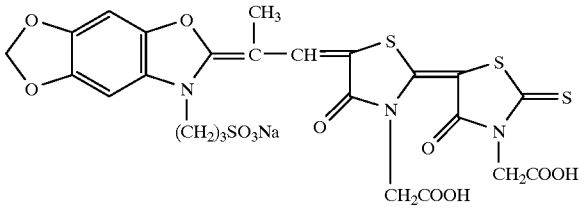
Sensitizing dye d-2
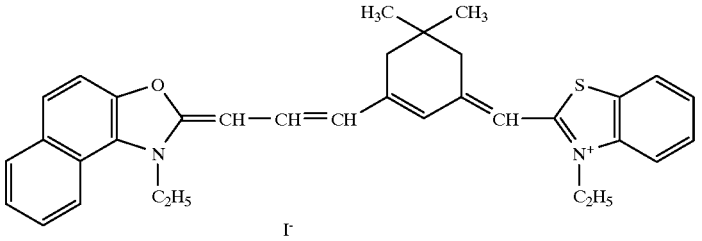
Hydrazine derivative HY-1
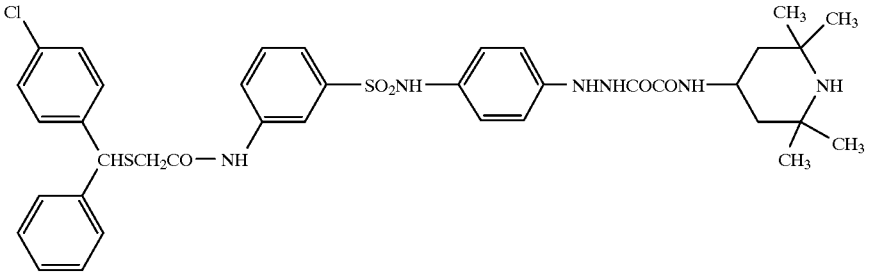
Neclear accelerating agent AM-1
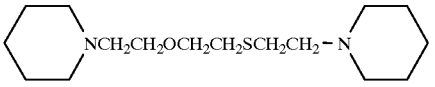

-continued
Redox compound RE-1
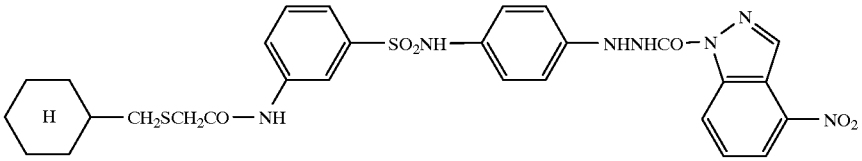
Compound e
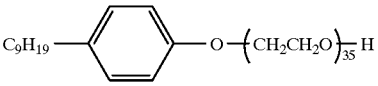
Latex polymer f
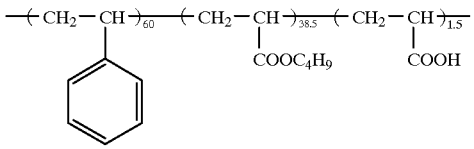
Hardener g
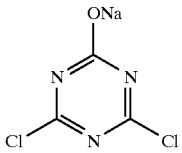
Hydrazine derivative HY-2
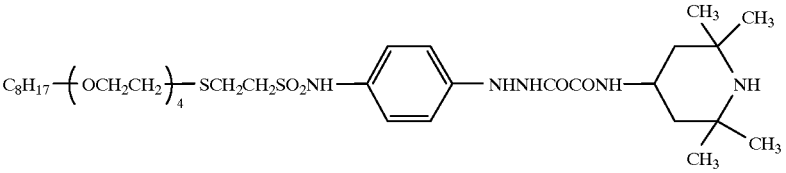
Dye b
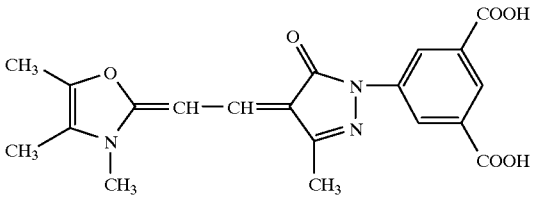
Surfactant h
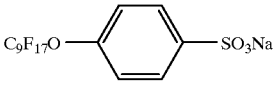
Hardener j
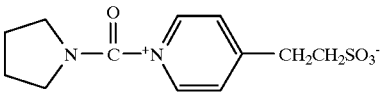

-continued

Compound i

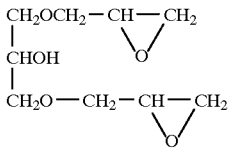

Dye k

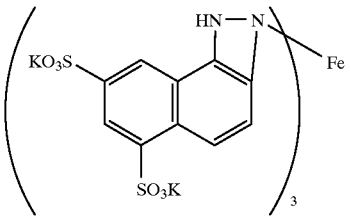

(Processing solution formula) 1. Developer (HAD-S) (for working solution of 1 liter)

| | | |
|---|---|---|
| Pure water | 300 | ml |
| Compound of the invention | amount shown in Table 1 | |
| Sodium sulfite | 52 | g |
| Potassium carbonate | 55 | g |
| 8-Mercaptoadenine | 0.06 | g |
| Diethylene glycol | 50 | g |
| 5-Methylbenzotrizole | 0.21 | g |
| 1-Phenyl-5-mercaptotetrazole | 0.03 | g |
| Dimezone S | 0.87 | g |
| Hydroquinone | 20 | g |
| Sodium erythorbate | 5 | g |

Using KOH (55% aqueous solution) and pure water, the total amount was made to 400 ml (pH 10.45). Pure water of 600 ml and the above solution of 400 ml were mixed to make a working developer solution of 1 liter.

2. Preparation of developer replenisher tablet

Preparation of granules Part A (corresponding to working solution of 1 liter)

| | | |
|---|---|---|
| 8-Mercaptoadenine | 0.11 | g |
| Dimezone S | 1.3 | g |
| 5-Methylbenzotrizole | 0.26 | g |
| Potassium sulfide | 7.07 | g |
| Sodium erythorbate | 6.0 | g |
| Hydroquinone | 24 | g |
| D-Sorbitol | 1.93 | g |

Above materials were mixed over a period of 30 min. by a commercially available bandom mill and granulated at room temperature over a period of 10 min. using a commercially available granulating machine. The resulting granules were cooled at about 5 mmHg in a batch type freeze drier, allowed to stand at −20° C. for 12 hours, and dried to give a moisture content of 1%. Thus, granules Part A was obtained.

Preparation of granules Part B (corresponding to working solution of 1 liter)

| | | |
|---|---|---|
| Compound of the invention | amount shown in Table 1 | |
| Sodium carbonate | 21.20 | g |
| Potassium carbonate | 27.60 | g |

-continued

| | | |
|---|---|---|
| Potassium bromide | 2.0 | g |
| Sodium sulfite | 59.51 | g |
| $LiOH \cdot H_2O$ | 9.0 | g |
| D-Mannitol (produced by Kao Co., Ltd.) | 8.5 | g |
| D-Sorbitol | 3.0 | g |

Above materials were mixed over a period of 30 min. by a commercially available bandom mill and granulated at room temperature over a period of 10 min. using a commercially available granulating machine. The resulting granules were cooled at about 5 mmHg in a batch type freeze drier, allowed to stand at −20° C. for 12 hours, and dried to give a moisture content of 1%. Thus, granules Part B was obtained.

Parts A and B were added with 0.73 g of sodium 1-octanesulfonate, and 0.81 g of sodium 1-octanesulfonate, respectively, and completely mixed over a period of 10 min. The resulting mixture was tabletted using a tabletting machine, Machina UD.DFE30.40 produced by Machina Co., at a tabletting pressure of 1.5 ton/$m^2$ to prepare tablets. Thus, developer replenisher tablet A with a weight of 10 g, a diameter of 30 mm and a thickness of 10 mm and developer replenisher tablet B with a weight of 13 g, a diameter of 30 mm and a thickness of 10 mm were obtained.

3. Fixer (for working solution of 1 liter)

| | | |
|---|---|---|
| Pure Water | 120 | ml |
| Ammonium thiosulfate (10% Na salt, product by Hoechst) | 140 | g |
| Sodium sulfite | 22 | g |
| Boric acid | 10 | g |
| Tartaric acid | 3 | g |
| Sodium acetate trihydride | 37.8 | g |
| Acetic acid (90% aq. solution) | 13.5 | g |
| Aluminum sulfate octadecahydride | 18 | g |

Using a 50% sulfuric acid solution and pure water, the total amount was made to 333 ml (pH 4.81). Pure water of 667 ml and the above solution of 333 ml were mixed to make 1 liter of a fixer working solution (pH 4.85).

4. Preparation of fixer replenisher tablet

Preparation of fixer tablets Part A (corresponding to fixer replenisher solution of 1 liter)

| | | |
|---|---|---|
| Ammonium thiosulfate (10% Na salt, product by Hoechst) | 145.8 | g |
| Sodium bisulfite | 14 | g |
| Sodium sulfite | 1.0 | g |
| Sodium acetate | 18 | g |
| Pineflow (product by Matsugaya Kagaku) | 9 | g |

Above materials were mixed over a period of 30 min. by a commercially available bandom mill and granulated at room temperature over a period of 10 min. using a commercially available granulating machine. The resulting granules were cooled at about 5 mmHg in a batch type freeze drier, allowed to stand at −20° C. for 12 hours, and dried to give a moisture content of 1%. Thus, granules Part A for fixer was obtained.

Preparation of fixer tablets Part B (corresponding to fixer replenisher solution of 1 liter)

| | | |
|---|---|---|
| Boric acid | 6 | g |
| Tartaric acid | 3 | g |
| Succinic acid | 13.2 | g |
| Sodium sulfiteAluminum sulrate octahydrate | 18 | g |
| Sodium acetate | 10 | g |
| D-mannitol | 2.5 | g |
| D-sorbitol | 1.15 | g |
| Macrogoal PEG#4000 | 1.5 | g |

Above materials were mixed over a period of 30 min. by a commercially available bandom mill and granulated at room temperature over a period of 10 min. using a commercially available granulating machine. The resulting granules were cooled at about 5 mmHg in a batch type freeze drier, allowed to stand at −20° C. for 12 hours, and dried to give a moisture content of 1%. Thus, granules Part B for fixer was obtained.

The above obtained Parts A and B were added with 2.82 g of sodium 1-octanesulfonate, and 0.49 g of sodium 1-octanesulfonate, respectively, and completely mixed over a period of 10 min. The resulting mixture was tabletted using a tabletting machine, Machina UD.DFE30.40 produced by Machina Co., at a tabletting pressure of 1.5 ton/$M^2$ to prepare tablets. Thus, fixer replenisher tablets A and B with a weight of 10 g, a diameter of 30 mm and a thickness of 10 mm were obtained.

Each of the above developer replenisher tablets (16 tablets of A, 46 tablets of B) and fixer replenisher tablets (76 tablets of A, 20 tablets of B) were sealed in a vessel made of polyethylene (with an oxygen permeability of 40 ml/atm·$m^2$·25 ·day) with a polypropylene cap, and further accommodated in a package made of an aluminum foil, and stored at 50° C. and 70% RH for two weeks.

In employing the above developer or fixer tablets, they were dissolved in water to make a 4 liter solution, respectively. Thus, a developer replenisher solution and a fixer replenisher solution were obtained.

The fixer replenisher solution was adjusted to 4.2 with a 50% sulfuric acid solution or a 30% NaOH solution. The pH of the developer replenisher solution was 10.72.

The above obtained light sensitive material sample were cut in a 508×610 mm sheet, and 20% of the size was exposed. Two thousand of the exposed sheets were running processed while the developer replenisher solution and the fixer replenisher solution are replenished in an amount of 250 ml/$m^2$ of light sensitive material to be processed, respectively, according to the following processing conditions, employing an automatic processor GR-26S (product by Konica Corp.) which had been modified to replenish tablets into the developer tank and the fixer tank.

Processing conditions:

| Step | Temperature | Time |
|---|---|---|
| Developing | 35° C. | 30 sec. |
| Fixing | 34° C. | 20 sec. |
| Washing | Ordinary temp. | 20 sec. |
| Drying | 45° C. | 20 sec. |

Evaluation Methods

Evaluation of Linearity or Dot Quality

The light sensitive material sample was exposed through a random-patterned halftone screen with 8 μm dot (FM screen) using SG-747RU (product by Dainippon Screen Co.) and processed to form halftone dot image. Medium dots (aimed at 50% dot) were visually evaluated, using 100 times magnifier, with respect to dot quality based on five grades of 5 (the best level) and 4, 3, 2, and 1 (the worst) along with deterioration of the dot quality. Grades of 1 or 2 are outside of practical use. Lineality was evaluated as follows: When the light senstive material was exposed with an exposure amount which gives a 2% developed dot area in a 2% theoretical dot area, the developed dot area in a 95% theoretical dot area was determined. The closer to 95% the dot area, the better the linearity. The measurement was carried out employing X-Rite 361T.

Evaluation of Black Spots

The black spots (sandy defects) at unexposed portions of the developed light sensitive material sample was observed through a magnifier at a magnification of 40 times, with respect to no black spots based on five grades of 5 (the best level) and 4, 3, 2, and 1 (the worst) along with increase of black spots. Grades of 1 or 2 are outside of practical use.

Evaluation of stain of film

After the running processing, a first light sensitive material sample was processed in the same manner as in the running processing, and stain on the processed sample was visually observed according to the following criteria:

A: No stain observed

B: Slight stain

C: Stain observed, but no practical problem

D: Considerable stain observed

E: Stain on entire surface of the film

A to C are within practical use.

Evaluation of Remained Color

The unexposed light sensitive material sample was processed in the same manner as in the running processing. Eight to ten sheets of the processed samples were stacked, and observed for remained color, based on five grades of 5, 4, 3 (level with no practical problem), 2, and 1. Grade of 5 are best, and Grade of 1 are worst.

Evaluation of Soil of processing tanks or rollers

After the running processing, the soil was observed accoding to the following criteria A to E:

A: No soil observed

B: Slight soil at rollers

C: Soil observed at rollers, but no practical problem

D: Soil observed at rollers, and floating matter observed in the fixer tank

E: Soil observed at rollers, and precipitations observed in the fixer tank

A and B are within practical use.

The results are shown in Table 1.

TABLE 1

| | Compound (I), (II) (g/l) | | Compound (III) (g/l) | | Compound (I), (II)/ Compound (III), molar ratio | Emulation protective layer $CaCl_2$ mg/m$^2$ | Emulation protective layer Ca mg/m$^2$ | Backing layer $CaCl_2$ mg/m$^2$ | Backing layer Ca mg/m$^2$ | Dot Quality | Linearity | Black Spots | Film Stain | Remained Color | Soil of Processor | Remarks |
|---|---|---|---|---|---|---|---|---|---|---|---|---|---|---|---|---|
| I-1 | EDTA | 2 | S-1 | 0.07 | 20.2 | 0 | 0 | 0 | 0 | 2 | 89 | 2 | D | 1 | D | Comp. |
| I-2 | EDTA | 4 | S-25 | 0.10 | 29.8 | 8.25 | 3 | 8.25 | 3 | 2 | 88 | 1 | D | 2 | D | Comp. |
| I-3 | 1-1 | 2 | — | 0 | ∞ | 13.75 | 5 | 13.75 | 5 | 2 | 89 | 1 | D | 2 | D | Comp. |
| I-4 | 1-7 | 1 | S-12 | 0.12 | 6.7 | 8.25 | 3 | 5.5 | 2 | 4 | 94 | 5 | B | 4 | B | Inv. |
| I-5 | 1-10 | 1.5 | S-20 | 0.16 | 12.6 | 11.00 | 4 | 5.5 | 2 | 5 | 95 | 5 | A | 4 | A | Inv. |
| I-6 | 1-34 | 1 | S-24 | 0.20 | 3.8 | 8.25 | 3 | 8.25 | 3 | 4 | 94 | 4 | A | 5 | A | Inv. |
| I-7 | 2-1 | 2 | S-39 | 0.09 | 12.7 | 19.25 | 7 | 19.25 | 7 | 5 | 95 | 5 | A | 4 | B | Inv. |
| I-8 | 2-1 | 3 | S-39 | 0.12 | 14.3 | 11.00 | 4 | 8.25 | 3 | 5 | 95 | 5 | A | 5 | A | Inv. |
| I-9 | 2-1 | 4 | S-39 | 0.15 | 15.3 | 11.00 | 4 | 8.25 | 3 | 5 | 95 | 5 | A | 5 | A | Inv. |
| I-10 | 2-6 | 2 | S-30 | 0.12 | 12.7 | 11.00 | 4 | 8.25 | 3 | 4 | 94 | 4 | B | 4 | A | Inv. |
| I-11 | 2-15 | 2 | S-39 | 0.25 | 5.1 | 11.00 | 4 | 8.25 | 3 | 5 | 95 | 5 | A | 4 | B | Inv. |
| I-12 | 2-6 | 2 | S-30 | 0.12 | 12.7 | 38.5 | 14 | 19.25 | 7 | 4 | 93 | 5 | C | 3 | B | Inv. |
| I-13 | 2-1 | 2 | S-39 | 0.12 | 14.3 | 0 | 0 | 0 | 0 | 5 | 94 | 5 | B | 5 | A | Inv. |
| I-14 | 2-1 | 2 | S-39 | 0.01 | 114 | 13.75 | 5 | 13.75 | 5 | 4 | 93 | 3 | B | 5 | C | Inv. |
| I-15 | 2-1 | 4 | S-39 | 0.03 | 76.5 | 16.5 | 6 | 8.25 | 3 | 5 | 94 | 4 | C | 5 | C | Inv. |
| I-16 | 2-1 | 0.02 | S-39 | 0.12 | 0.14 | 27.5 | 10 | 13.75 | 5 | 3 | 92 | 5 | B | 4 | C | Inv. |
| I-17 | 2-1 | 0.2 | S-39 | 1.8 | 0.06 | 27.5 | 10 | 13.75 | 5 | 3 | 92 | 5 | C | 3 | B | Inv. |

As is apparent from Table 1, the comparative samples exhibit poor results. In contrast, the inventive samples, which can be put into practical use, exhibit excellent linearity and dot quality without producing black spots or stains on the processed samples and without producing soil inside the automatic processor.

Example 2

Experiment and evaluation were conducted in the same manner as in Example 1, except that compounds and calcium content as shown in Table 2 were employed, the replenishing amount of the developer replenisher solution and the fixer replenisher solution were varied as follows, and the processing conditions were varied as follows:

Replenishing amount of developer replenisher solution: 130 ml/m$^2$

Replenishing amount of developer replenisher solution: 130 ml/M$^2$

Processing conditions:

| Step | Temperature | Time |
|---|---|---|
| Developing | 35° C. | 15 sec. |
| Fixing | 34° C. | 10 sec. |
| Washing | Ordinary temp. | 10 sec. |
| Drying | 50 C. | 10 sec. |

The results are shown in Table 2.

TABLE 2

| | Compound (I), (II) (g/l) | | Compound (III) (g/l) | | Compound (I), (II)/ Compound (III), molar ratio | Emulation protective layer $CaCl_2$ mg/m$^2$ | Emulation protective layer Ca mg/m$^2$ | Backing layer $CaCl_2$ mg/m$^2$ | Backing layer Ca mg/m$^2$ | Dot Quality | Linearity | Black Spots | Film Stain | Remained Color | Soil of Processor | Remarks |
|---|---|---|---|---|---|---|---|---|---|---|---|---|---|---|---|---|
| II-1 | EDTA | 1 | S-35 | 0.06 | 16.3 | 0 | 0 | 0 | 0 | 2 | 88 | 2 | D | 2 | E | Comp. |
| II-2 | EDTA | 3 | S-39 | 0.10 | 21.1 | 8.25 | 3 | 2.75 | 1 | 1 | 80 | 1 | E | 1 | D | Comp. |
| II-3 | 1-7 | 2 | — | 0 | ∞ | 8.25 | 3 | 2.75 | 1 | 2 | 89 | 1 | E | 1 | E | Comp. |
| II-4 | 1-19 | 2 | S-25 | 0.15 | 12.4 | 8.25 | 3 | 2.75 | 1 | 4 | 94 | 5 | A | 5 | B | Inv. |
| II-5 | 1-34 | 2 | S-27 | 0.20 | 8.1 | 8.25 | 3 | 2.75 | 1 | 4 | 96 | 4 | B | 4 | A | Inv. |
| II-6 | 2-1 | 1 | S-39 | 0.06 | 9.5 | 8.25 | 3 | 2.75 | 1 | 5 | 94 | 5 | B | 4 | A | Inv. |
| II-7 | 2-1 | 2.5 | S-39 | 0.10 | 14.3 | 0 | 0 | 0 | 0 | 5 | 95 | 5 | A | 4 | A | Inv. |
| II-8 | 2-1 | 5 | S-39 | 0.11 | 26.0 | 13.75 | 5 | 13.75 | 5 | 5 | 95 | 5 | A | 5 | A | Inv. |
| II-9 | 2-6 | 0.5 | S-32 | 0.05 | 9.3 | 19.25 | 7 | 19.25 | 7 | 4 | 94 | 4 | B | 4 | B | Inv. |
| II-10 | 2-12 | 1 | S-35 | 0.07 | 10.8 | 11.00 | 4 | 8.25 | 3 | 4 | 94 | 5 | A | 5 | B | Inv. |
| II-11 | 2-20 | 1.5 | S-38 | 0.08 | 11.1 | 11.00 | 4 | 8.25 | 3 | 5 | 95 | 5 | A | 4 | A | Inv. |
| II-12 | 2-23 | 2.5 | S-39 | 0.20 | 5.9 | 8.25 | 3 | 8.25 | 3 | 4 | 96 | 4 | B | 5 | A | Inv. |
| II-13 | 2-1 | 2.5 | S-39 | 0.10 | 14.3 | 55.0 | 20 | 27.5 | 10 | 4 | 94 | 4 | C | 4 | C | Inv. |
| II-14 | 2-1 | 2.5 | S-39 | 0.10 | 14.3 | 27.5 | 10 | 13.75 | 5 | 5 | 95 | 5 | B | 5 | B | Inv. |
| II-15 | 2-1 | 2.5 | S-39 | 0.01 | 143 | 13.75 | 5 | 13.75 | 5 | 5 | 95 | 3 | B | 4 | B | Inv. |
| II-16 | 2-12 | 4 | S-35 | 0.035 | 86 | 13.75 | 5 | 13.75 | 5 | 5 | 95 | 4 | C | 4 | C | Inv. |
| II-17 | 2-23 | 2.0 | S-39 | 1.0 | 0.95 | 27.5 | 10 | 13.75 | 5 | 3 | 93 | 4 | B | 4 | C | Inv. |
| II-18 | 2-1 | 0.25 | S-39 | 0.2 | 0.72 | 27.5 | 10 | 13.75 | 5 | 4 | 94 | 4 | C | 4 | C | Inv. |

As is apparent from Table 2, the comparative samples exhibit poor results. In contrast, the inventive samples exhibit excellent linearity and dot quality without producing black spots or stains on the processed samples and without producing soil inside the automatic processor, which can be put into practical use.

What is claimed is:

1. A method of processing an exposed black and white photographic light-sensitive material employing an automatic processor, the method comprising the steps of:

developing the exposed material with a developer, the developer is replenished with a developer replenisher;

fixing the developed material with a fixer;

washing the fixed material; and drying the washed material, wherein the developer contains a developing agent, a third compound represented by the following Formula (III) and at least one of a first compound represented by the following formula (I) and a second compound represented by the following formula (II):

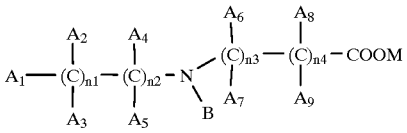

wherein B represents a hydrogen atom, —OH, or —$CH_2COOM$, provided that when B represents a hydrogen atom, said Formula (I) is represented by any one of the following formulae I-1 through I-15, I-17 through I-30, and I-36 through I-62, or when B represents —OH or —$CH_2COOM$, $n_1$ and $n_2$ are integers satisfying $n_1+n_2=2$, $n_3$ is 0, $n_4$ is 1, $A_1$, $A_8$ and $A_9$ represent a hydrogen atom, —OH, —COOM, —$PO_3(M)_2$, —$CH_2COOM$, —$CH_2OH$ or a lower alkyl group and at least one of $A_2$, $A_3$, $A_4$, and $A_5$ represents —$CH_2COOM$, —COOM or —$PO_3(M)_2$; and M represents a hydrogen atom, an alkali metal atom or an ammonium group, wherein formulae I-1 through I-15, I-17 through I-30 and I-36 through I-62 are as follows:

I-1

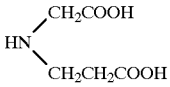

I-2

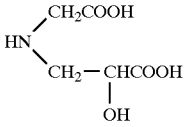

I-3

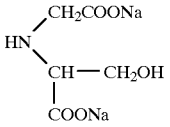

I-4

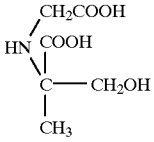

-continued

I-5

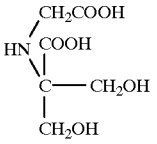

I-6

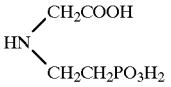

I-7

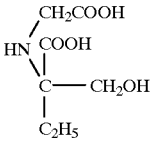

I-8

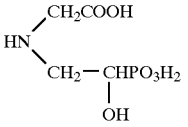

I-9

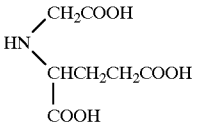

I-10

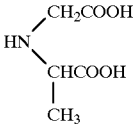

I-11

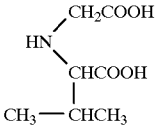

I-12

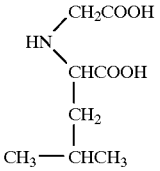

I-13

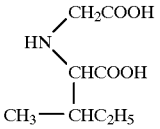

I-14

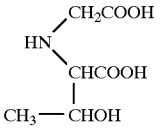

-continued
I-15
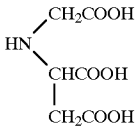
I-17
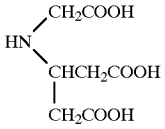
I-18
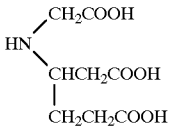
I-19
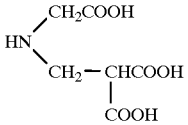
I-20
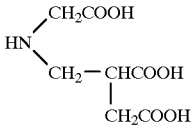
I-21
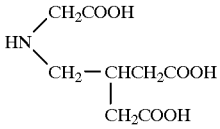
I-22
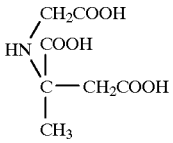
I-23
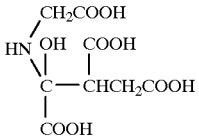
I-24
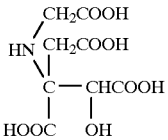
I-25
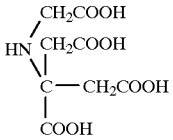
-continued
I-26
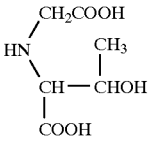
I-27
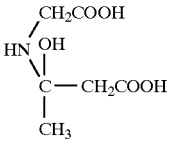
I-28
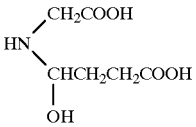
I-29
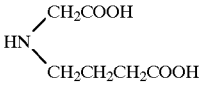
I-30
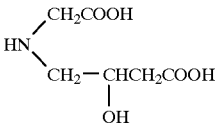
I-41
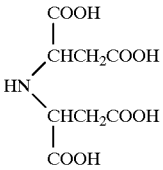
I-42
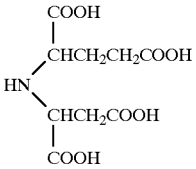
I-43
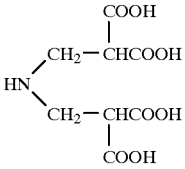
I-44
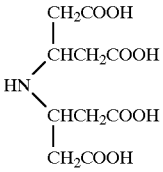

-continued
I-45
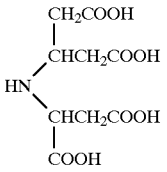
I-46
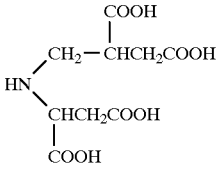
I-47
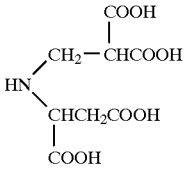
I-48
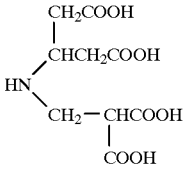
I-49
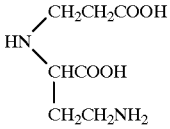
I-50
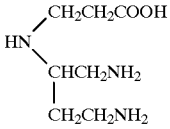
I-51
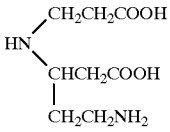
I-52
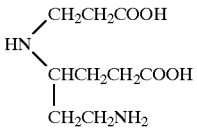
I-53
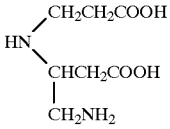
I-54
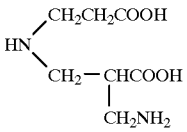
-continued
I-55
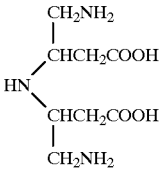
I-56
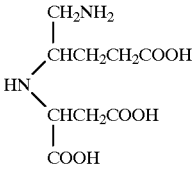
I-57
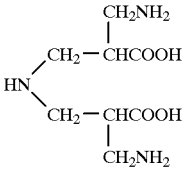
I-58
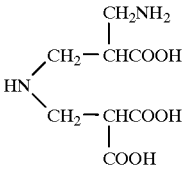
I-59
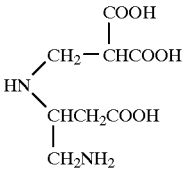
I-60
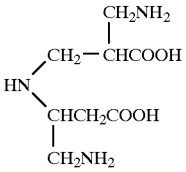
I-61
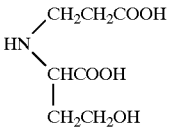
I-62
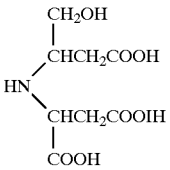

Formula (II)

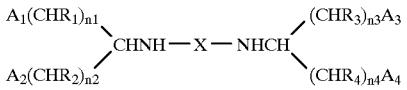

wherein $A_1$, $A_2$, $A_3$ and $A_4$ independently represent —COOM or —OH; $n_1$, $n_2$, $n_3$ and $n_4$ independently represent an integer of 0 to 2; $R_1$, $R_2$, $R_3$ and $R_4$ independently represent a hydrogen atom, —OH or a lower alkyl group; X represents an alkylene group having 2 to 6 carbon atoms or $—(B_1O)_m—B_2—$in which $B_1$ and $B_2$ independently represent an alkylene group having 1 to 5 carbon atoms, and m represents an integer of 1 to 5; and M represents a hydrogen atom, an alkali metal atom or an ammonium group, $Z^1—SM^1$ Formula (III)

wherein $Z^1$ represents an alkyl group, an aryl group or a heterocyclic group, provided that each group has, as a substituent, at least one selected from the group consisting of a hydroxy group, $—SO_3M_1$, $—COOM_1$ (in which $M_1$ represents a hydrogen atom, an alkali metal atom or a substituted or unsubstituted ammonium group), a substituted or unsubstituted amino group and a substituted or unsubstituted ammonio group or a substituent having at least one selectd from the above mentioned group; $M^1$ represents a hydrogen atom, an alkali metal atom or a substituted or unsubstituted amidino group which may form a hydrogen halogenide salt or a sulfonic acid salt, and provided that when $Z^1$ is a heterocyclic group, said Formula (III) is represented by any one of the following formulae A, B, C, D, E, and F:

Formula A

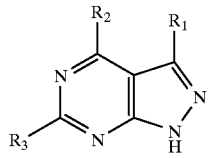

Formula B

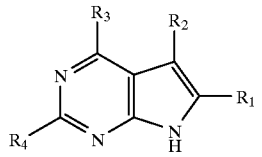

Formula C

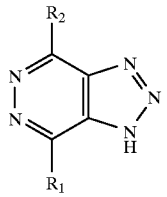

Formula D

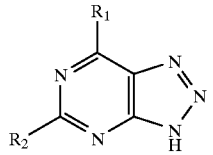

-continued

Formula E

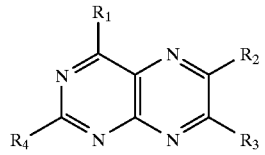

Formula F

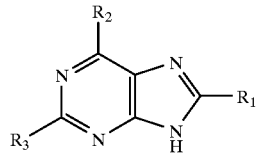

wherein in Formulas A and F, $R_1$, $R_2$ and $R_3$ independently represent a hydrogen atom, a halogen atom, a substituted or unsubstituted lower alkyl group having 1 to 5 carbon atoms, a substituted or unsubstituted lower alkenyl group having 2 to 5 carbon atoms, a substituted or unsubstituted lower alkoxy group having 1 to 5 carbon atoms, a phenyl group, $—SM_1$, a hydroxy group, $—COOM_2$, $—SO_3M_3$, a substituted or unsubstituted amino group, or a carbamoyl group, provided that at least one of $R_1$, $R_2$ and $R_3$ is $—SM_1$, and at least one of the rest is a group selected from the group consisting of a hydroxy group, $—COOM_2$, $—SO_3M_3$, and a substituted or unsubstituted amino group, in which $M_1$, $M_2$ and $M_3$ may be the same or different, and independently represent a hydrogen atom, an alkali metal atom or a substituted or unsubstituted ammonium group; in Formulas B and E, $R_1$, $R_2$, $R_3$ and $R_4$ independently represent a hydrogen atom, a halogen atom, a substituted or unsubstituted lower alkyl group having 1 to 5 carbon atoms, a substituted or unsubstituted lower alkenyl group having 2 to 5 carbon atoms, a substituted or unsubstituted lower alkoxy group having 1 to 5 carbon atoms, a phenyl group, $—SM_1$, a hydroxy group, $—COOM_2$, $—SO_3M_3$, a substituted or unsubstituted amino group, or a carbamoyl group, provided that at least one of $R_1$, $R_2$, $R_3$ and $R_4$ is $—SM_1$, and at least one of the rest is a group selected from the group consisting of a hydroxy group, $—COOM_2$, $—SO_3M_3$, and a substituted or unsubstituted amino group, in which $M_1$, $M_2$ and $M_3$ may be the same or different, and independently represent a hydrogen atom, an alkali metal atom or a substituted or unsubstituted ammonium group; and in Formulas C and D, $R_1$ and $R_2$ independently represent a hydrogen atom, a halogen atom, a substituted or unsubstituted lower alkyl group having 1 to 5 carbon atoms, a substituted or unsubstituted lower alkenyl group having 2 to 5 carbon atoms, a substituted or unsubstituted lower alkoxy group having 1 to 5 carbon atoms, a phenyl group, $—SM_1$, a hydroxy group, $—COOM_2$, $—SO_3M_3$, a substituted or unsubstituted amino group, or a carbamoyl group, provided that one of $R_1$ and $R_2$ is $—SM_1$, and the other of $R_1$ and $R_2$ is a group selected from the group consisting of a hydroxy group, $—COOM_2$, $—SO_3M_3$, and a substituted or unsubstituted amino group, in which $M_1$, $M_2$ and $M_3$ may be the same or different, and independently represent a hydrogen atom, an alkali metal atom or a substituted or unsubstituted ammonium group.

2. The method of claim 1, wherein the content in the developer of the developing agent is 15 to 80 g per liter, the content in the developer of the third compound is $10^{-5}$ to $10^{-2}$ mol per liter, and the content ratio (molar ratio) of at least one of the first compound and the second to the third compound is 0.1:1to 100:1.

3. The method of claim 1, wherein the second compound is ethylenediamine-N,N'-discuccinic acid.

4. The method of claim 1, wherein the developer contains a developing agent, the third compound and ethylenediamine-N,N'-disuccinic acid.

5. The method of claim 1, wherein the material contains Ca in an amount of 0 to 15 $mg/m^2$.

6. The method of claim 5, wherein the material contains no calcium.

7. The method of claim 1, wherein the developer replenisher is prepared by dissolving in water first tablets containing the third compound and at least one of the first compound and the second compound, and second tablets containing the developing agent.

8. The method of claim 1, wherein the developer replenisher is prepared by dissolving in water first tablets containing ethylenediamine-N,N'-disuccinic acid and second tablets containing the developing agent.

9. The method of claim 1, wherein the replenishing amount of the developer replenisher is 50 to 250 $ml/m^2$.

10. The method of claim 1, wherein 70% or more of the optical isomer oft he first compound or the second compound are an [S, S] isomer.

11. The method of claim 10, wherein 90% or more of the optical isomer of the first compound or the second compound are an [S, S] isomer.

* * * * *